US006895792B2

(12) United States Patent
Davis

(10) Patent No.: US 6,895,792 B2
(45) Date of Patent: May 24, 2005

(54) ELECTRONIC LOCKING SYSTEM

(75) Inventor: Paul R. Davis, Corvallis, OR (US)

(73) Assignee: Videx, Inc., Corvallis, OR (US)

( * ) Notice: Subject to any disclaimer, the term of this patent is extended or adjusted under 35 U.S.C. 154(b) by 0 days.

(21) Appl. No.: 10/617,345

(22) Filed: Jul. 9, 2003

(65) Prior Publication Data

US 2004/0007032 A1 Jan. 15, 2004

Related U.S. Application Data

(63) Continuation of application No. 10/202,435, filed on Jul. 22, 2002, now Pat. No. 6,604,394, which is a continuation of application No. 09/784,228, filed on Feb. 13, 2001, now Pat. No. 6,474,122, which is a continuation-in-part of application No. 09/491,488, filed on Jan. 25, 2000, now Pat. No. 6,615,625.

(51) Int. Cl.[7] ..... E05B 47/06

(52) U.S. Cl. ..... 70/278.3; 70/278.7; 70/283.1; 70/386; 70/389; 70/416

(58) Field of Search ..... 70/278.2, 278.3, 70/279.1, 278.7, 283, 283.1, 389, 416, 417, 421, 386, 276, 277, 367–369, 371, 379 R, 379 A, 380

(56) References Cited

U.S. PATENT DOCUMENTS

| | | | | |
|---|---|---|---|---|
| 1,564,463 | A | 12/1925 | Best | 70/380 |
| 2,082,806 | A | 6/1937 | Michel | 70/283 |
| 2,124,936 | A | 7/1938 | Wehrs | 70/141 |
| 2,763,888 | A | 9/1956 | Billeter | 16/59 |
| 2,855,588 | A | 10/1958 | Allen | |
| 3,093,994 | A | 6/1963 | Richard | 70/434 |
| 3,134,254 | A | 5/1964 | Richard | 70/227 |
| 3,332,713 | A | 7/1967 | DeClaire et al. | |
| 3,392,558 | A | 7/1968 | Hedin et al. | 70/227 |
| 3,403,380 | A | 9/1968 | Welch | |
| 3,404,549 | A | 10/1968 | Best | 70/373 |
| 3,418,833 | A | 12/1968 | Kerr | 70/421 |
| 3,508,031 | A | 4/1970 | Cooper, Jr. | |
| 3,509,748 | A | 5/1970 | Trainor | 70/389 |
| 3,641,396 | A | 2/1972 | Kossen et al. | |
| 3,651,464 | A | 3/1972 | Hedin et al. | 340/149 R |
| 3,660,729 | A | 5/1972 | James et al. | |
| 3,731,963 | A | 5/1973 | Pond | 292/144 |
| 3,733,861 | A | 5/1973 | Lester | 70/277 X |
| 3,798,935 | A | 3/1974 | Blekking et al. | 70/100 |
| 3,843,174 | A | 10/1974 | Bogunovich et al. | 292/166 |
| 3,854,310 | A | 12/1974 | Paul et al. | 70/280 |
| 3,859,634 | A | 1/1975 | Perron et al. | |
| 3,872,435 | A | 3/1975 | Cestaro | |
| 3,939,679 | A | 2/1976 | Barker et al. | 70/277 |
| 3,944,976 | A | 3/1976 | France | |
| 3,953,991 | A | 5/1976 | Grossman | 70/104 |
| RE29,259 | E | 6/1977 | Sabsay | |
| RE29,341 | E | 8/1977 | Peters et al. | 70/280 X |
| 4,051,548 | A | 9/1977 | Hamada | 70/280 X |
| 4,083,424 | A | 4/1978 | von den Stemmen et al. | 361/172 X |
| 4,099,752 | A | 7/1978 | Geringer | 292/144 |
| 4,127,966 | A | 12/1978 | Schmidt | 49/141 |

(Continued)

FOREIGN PATENT DOCUMENTS

| | | |
|---|---|---|
| EP | 0128991 | 12/1984 |
| EP | 0290330 | 11/1988 |
| GB | 1 525 033 | 9/1978 |
| GB | 2 119 548 A | 11/1983 |

*Primary Examiner*—Lloyd A. Gall
(74) *Attorney, Agent, or Firm*—Chernoff, Vilhauer, McClung & Stenzel, LLP

(57) ABSTRACT

In a first aspect, an electronic lock (12) suitable for replacing interchangeable core locks has a solenoid assembly comprising a solenoid coil (280) and a plunger (290) longitudinally aligned parallel to the rotational axis (A) of the cylinder (214) of the lock (12).

10 Claims, 16 Drawing Sheets

U.S. PATENT DOCUMENTS 4,148,092 A 4/1979 Martin ..... 70/149 X
4,157,534 A 6/1979 Schachter ..... 70/264 X
4,201,887 A 5/1980 Burns
4,209,782 A 6/1980 Donath et al.
4,262,504 A 4/1981 Inoue ..... 70/151 R
4,317,157 A 2/1982 Eckloff ..... 361/172
4,353,064 A 10/1982 Stamm
4,525,805 A 7/1985 Prosan et al.
4,557,121 A 12/1985 Charlton ..... 70/279.1
4,578,969 A 4/1986 Larson ..... 70/366
4,579,376 A 4/1986 Charlton ..... 70/279.1
4,594,637 A 6/1986 Falk ..... 361/172
4,603,564 A 8/1986 Kleinhäny et al. ..... 70/277
4,626,007 A 12/1986 Larson ..... 292/65
4,631,939 A 12/1986 Herriott ..... 70/389 X
4,633,688 A 1/1987 Beudat et al. ..... 70/280 X
4,702,094 A 10/1987 Peterson ..... 70/241
4,712,398 A 12/1987 Clarkson et al. ..... 70/276
4,727,368 A 2/1988 Larson et al. ..... 70/63 X
4,744,021 A 5/1988 Kristy ..... 361/172 X
4,766,746 A 8/1988 Henderson et al. ..... 70/63
4,771,620 A 9/1988 Kleinhäny ..... 70/358 X
4,789,859 A 12/1988 Clarkson et al.
4,798,068 A 1/1989 Nakauchi ..... 70/276
4,810,861 A 3/1989 Herriott et al. ..... 235/382
4,829,296 A 5/1989 Clark et al.
4,831,851 A 5/1989 Larson
4,870,400 A 9/1989 Downs et al.
4,887,292 A 12/1989 Barrett et al. ..... 70/63 X
4,895,036 A 1/1990 Larson et al. ..... 70/284
4,896,246 A 1/1990 Henderson et al.
4,914,732 A 4/1990 Henderson et al. ..... 70/271 X
4,916,443 A 4/1990 Barrett et al. ..... 70/271 X
4,916,927 A 4/1990 O'Connell et al. ..... 70/276
4,929,880 A 5/1990 Henderson et al. ..... 70/63 X
4,936,894 A 6/1990 Larson et al. ..... 70/298
4,947,163 A 8/1990 Henderson et al. ..... 70/63 X
4,962,449 A 10/1990 Schlesinger ..... 364/200
4,982,587 A 1/1991 Tzou ..... 70/492
4,988,987 A 1/1991 Barrett et al. ..... 70/63 X
5,010,750 A 4/1991 Böser et al. ..... 70/276
5,046,084 A 9/1991 Barrett et al. ..... 70/63 X
5,090,222 A 2/1992 Imran ..... 70/63
5,140,317 A 8/1992 Hyatt, Jr. et al.
5,177,988 A 1/1993 Bushnell ..... 70/175 X
5,181,406 A 1/1993 Wolter ..... 70/389 X
5,193,372 A 3/1993 Sieg et al. ..... 70/369
5,216,909 A 6/1993 Armoogam ..... 70/283 X
5,245,652 A 9/1993 Larson et al. ..... 70/63
5,267,460 A 12/1993 Burleigh ..... 70/316 X
5,280,518 A 1/1994 Danler et al.
5,319,362 A 6/1994 Hyatt, Jr.
5,335,520 A 8/1994 Lee ..... 70/389 X
5,339,662 A 8/1994 Goldman ..... 70/432 X
5,361,614 A 11/1994 Metcalf ..... 70/389
5,367,295 A 11/1994 Gokcebay et al.
5,421,178 A 6/1995 Hamel et al. ..... 70/283
5,475,375 A 12/1995 Barrett et al. ..... 70/63 X
5,507,162 A 4/1996 Chhatwal ..... 70/283 X
5,542,274 A 8/1996 Thordmark et al. ..... 70/495
5,550,529 A 8/1996 Burge ..... 70/447 X
5,552,777 A 9/1996 Gokcebay et al.
5,582,050 A 12/1996 Häggström ..... 70/495
5,602,536 A 2/1997 Henderson et al.
5,609,051 A 3/1997 Donaldson ..... 70/303 A
5,654,696 A 8/1997 Barrett et al. ..... 70/63 X
5,664,449 A 9/1997 Sedley ..... 70/276
5,705,991 A 1/1998 Kniffin et al. ..... 70/337 X
5,745,044 A 4/1998 Hyatt, Jr. et al.
5,768,921 A 6/1998 Hill ..... 70/63
5,791,177 A 8/1998 Bianco ..... 70/189 X
5,794,465 A 8/1998 Hill ..... 70/63
5,819,563 A 10/1998 Bianco ..... 70/283 X
5,826,450 A 10/1998 Lerchner et al. ..... 70/277 X
5,839,307 A 11/1998 Field et al. ..... 70/283
5,856,771 A 1/1999 Nippert ..... 335/262
5,902,209 A 5/1999 Moody ..... 70/247 X
5,911,401 A 6/1999 Hrytzak et al. ..... 335/262 X
6,000,609 A 12/1999 Gokcebay et al. ..... 70/277 X
6,005,487 A 12/1999 Hyatt, Jr. et al. ..... 70/472 X
6,012,311 A 1/2000 Duckwall ..... 70/369
6,082,153 A 7/2000 Schoell et al. ..... 70/1.5
6,085,560 A 7/2000 Dalton, Jr. ..... 70/278.3
6,125,673 A 10/2000 Luker ..... 70/276
6,155,089 A 12/2000 Hurkaineu et al. ..... 70/278.3
6,209,367 B1 * 4/2001 Hyatt et al. ..... 70/278.2
6,334,347 B1 1/2002 Iscla ..... 70/278.3
6,474,122 B2 11/2002 Davis ..... 70/278.3
6,564,601 B2 5/2003 Hyatt Jr. ..... 70/278.3
6,588,243 B1 * 7/2003 Hyatt et al. ..... 70/278.1
6,604,394 B2 * 8/2003 Davis ..... 70/278.3
6,615,625 B2 * 9/2003 Davis ..... 70/278.3
6,718,806 B2 * 4/2004 Davis ..... 70/278.3

* cited by examiner

THE LOCK INTERFACE

THE KEY INTERFACE

ELECTRONIC LOCKING SYSTEM

This application is a continuation of patent application Ser. No. 10/202,435, filed Jul. 22, 2002, now U.S. Pat. No. 6,604,394 B2; which is a continuation of patent application Ser. No. 09/784,228, filed Feb. 13, 2001, now U.S. Pat. No. 6,474,122; which is a continuation-in-part of patent application Ser. No. 09/491,488, filed Jan. 25, 2000, now U.S. Pat. No. 6,615,625 B2, the priority of which is hereby claimed.

BACKGROUND OF THE INVENTION

The present invention relates to an electronic lock.

Electronic locks have many advantages over entirely mechanical locks. For example, electronic locks used in combination with a microprocessor or a computer can be programed to control the electronic lock by time of day, by authorization codes, or other factors that may be programed into the processor. When a key is lost, instead of replacing the electronic lock, the electronic lock may be reprogrammed to accept a different identification code from a different key.

However, electronic locks suffer from a number of drawbacks. First, the locks require a source of power. If the power source is provided within the lock, such as in the form of a battery, then the power supply occupies space within the lock, making the lock larger. Such batteries may also be prone to corrosion which can affect the internal parts of the lock. In addition, if the battery loses power, then the lock may no longer be able to function. Further, the lock must be accessed periodically in order to change the battery. Providing power from a standard electrical power line is an alternative, but requires providing wiring to the lock. Further, such wiring may not be available in some environments, such as a desk or cabinet.

It is also desired to make the locks as small as possible, so that the electronic lock may be installed in place of an existing mechanical lock. Conventional mechanical locks used with desks or cabinets are relatively small. Thus, the space available within such a lock is confined, limiting the size and number of components that may be used within a lock.

In particular, it is desired to replace a mechanical lock having a replaceable or interchangeable core, such as those described in U.S. Pat. Nos. 3,206,959, 4,294,093 and 5,136,869. Such locks are sometimes referred to as "interchangeable core" locks. However, a problem arises due to the elongate throw pins used with such interchangeable core locks. The lock must be capable of accepting the pair of elongate throw pins which are used to throw a secondary locking mechanism such as a bolt to which the lock is attached. Accommodating elongate throw pins further restricts the space available within the lock.

Another difficulty with electronic locks is that they are susceptible to opening in response to sharp blows. Typically, electronic locks use a solenoid. However, it is often possible to jar a solenoid plunger so that an electronic lock may be opened by applying a sharp force to the lock, such as striking a lock with a hammer.

Another problem with electronic locks is that often a solenoid is used to move a plunger into and out of interfering relationship with the internal cylinder and the external shell. This may result in several problems. First, the solenoid and its plunger must be constructed to withstand the primary force directed on the plunger when a person attempts to rotate the cylinder when locked. Another problem is that the electronic lock may be difficult to lock, since it may be difficult to align the plunger with its corresponding bore. If the plunger does not align properly with the bore, the plunger cannot enter the bore so as to interfere with the movement of the cylinder.

Another difficulty is that the lock must be protected from being opened by an externally applied magnetic field. Where the lock has moving parts made of steel or other ferrous material, it may be possible to open the lock without the key by applying a large external magnetic field to the lock. In particular, where a solenoid is used, the solenoid plunger must be prevented from being moved out of locking position by an externally applied magnetic field.

Yet another problem is that some electronic locks allow removal of the key during rotation of the lock. In that event, a person may forget to return the cylinder to its locked position after the lock has been opened.

Accordingly, what is therefore desired is an electronic lock that occupies a small volume, that may be used to replace existing mechanical locks (including interchangeable core locks), that does not require a power source inside of the lock or external wiring, that is not susceptible to being opened in response to tampering (including tampering by means of an externally applied magnetic field), that may be consistently returned to a position that allows secure locking, and that prevents withdrawal of a key during operation.

BRIEF SUMMARY OF THE INVENTION

The present invention provides an electronic locking system that overcomes the aforesaid drawbacks of the prior art.

In a first separate aspect of the invention, an electronic lock is provided that may be used to replace conventional interchangeable core locks that employ elongate throw pins. The lock has a locking mechanism which includes a longitudinally oriented solenoid assembly which is parallel to the longitudinal rotational axis of the cylinder. The lock defines within the cylinder an elongate longitudinally aligned cavity capable of receiving the elongate throw pins.

In a second separate aspect of the invention, an electronic locking system is provided that resists external magnetic influences. The lock provides a ferromagnetic enclosure that at least partially surrounds the solenoid plunger when the locking mechanism resists rotation of the cylinder. Application of an externally applied magnetic field urges the solenoid plunger in a direction out of the enclosure to a position where the solenoid plunger operably interferes with opening of the lock.

The foregoing and other features and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
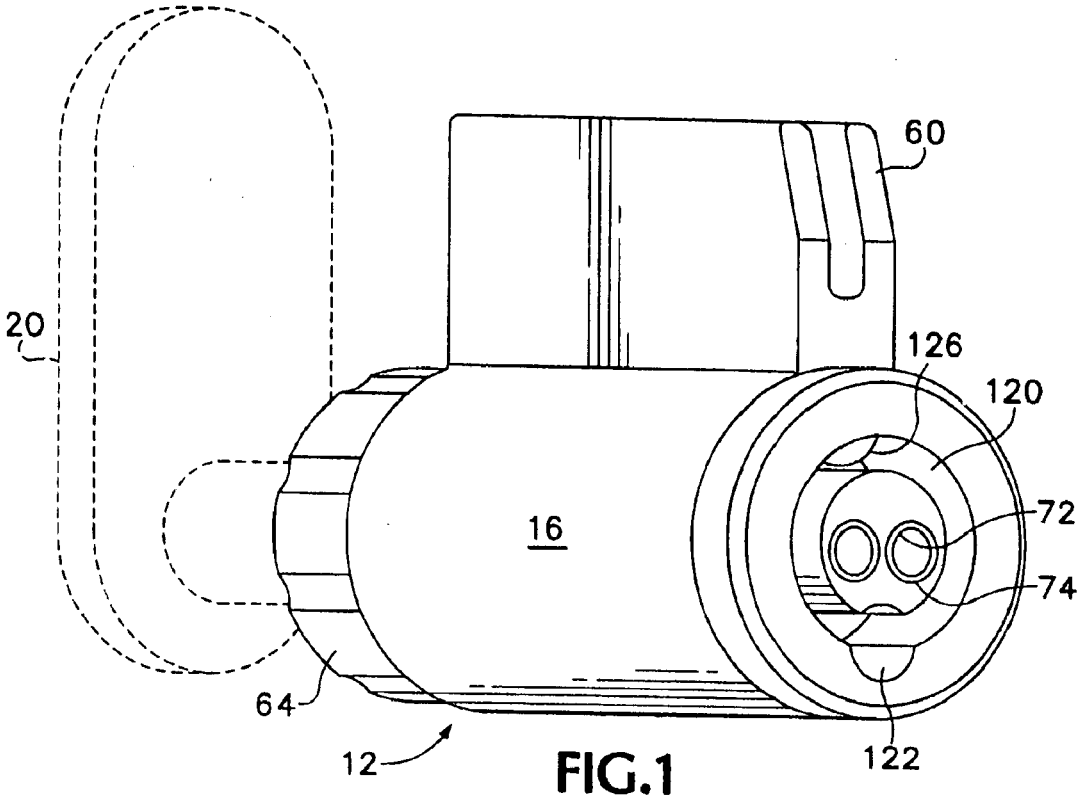
FIG. 1 is a perspective view of an exemplary lock of the present invention.
Figure 2:
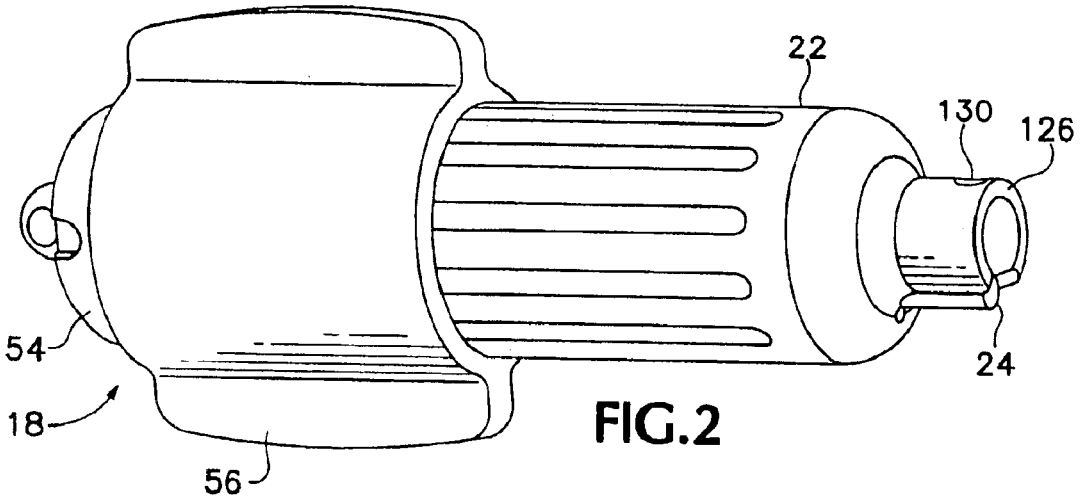
FIG. 2 is a perspective view of an exemplary key.
Figure 3:
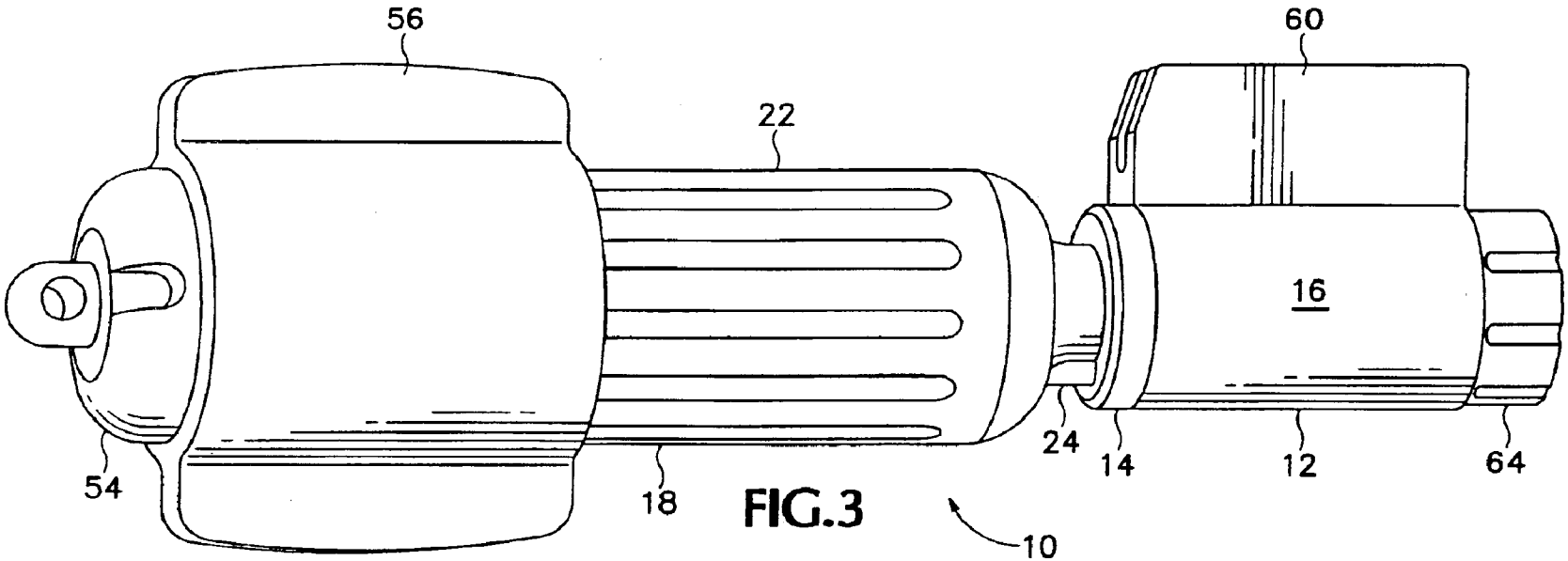
FIG. 3 is a perspective view of an exemplary key engaging an exemplary core.
Figure 4:
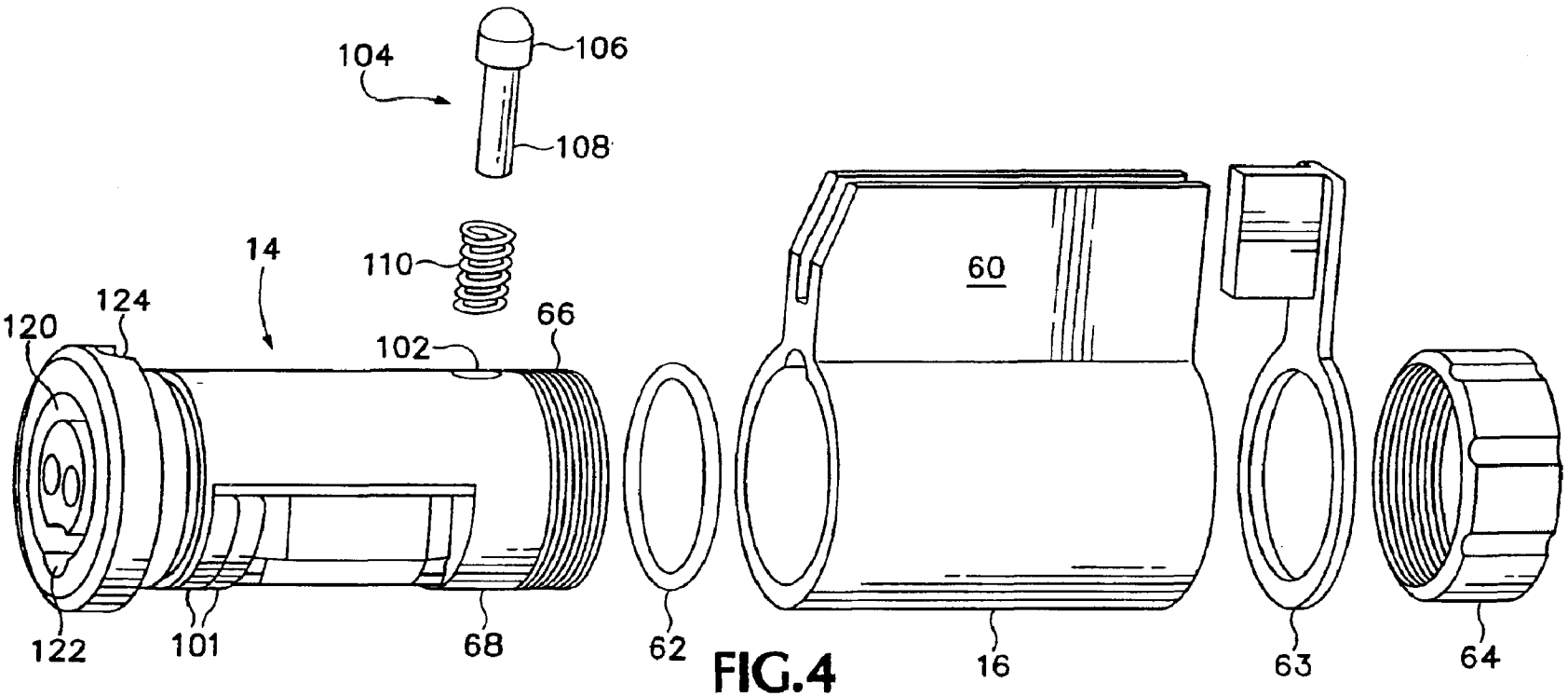
FIG. 4 is an exploded assembly view of an exemplary lock.
Figure 5:
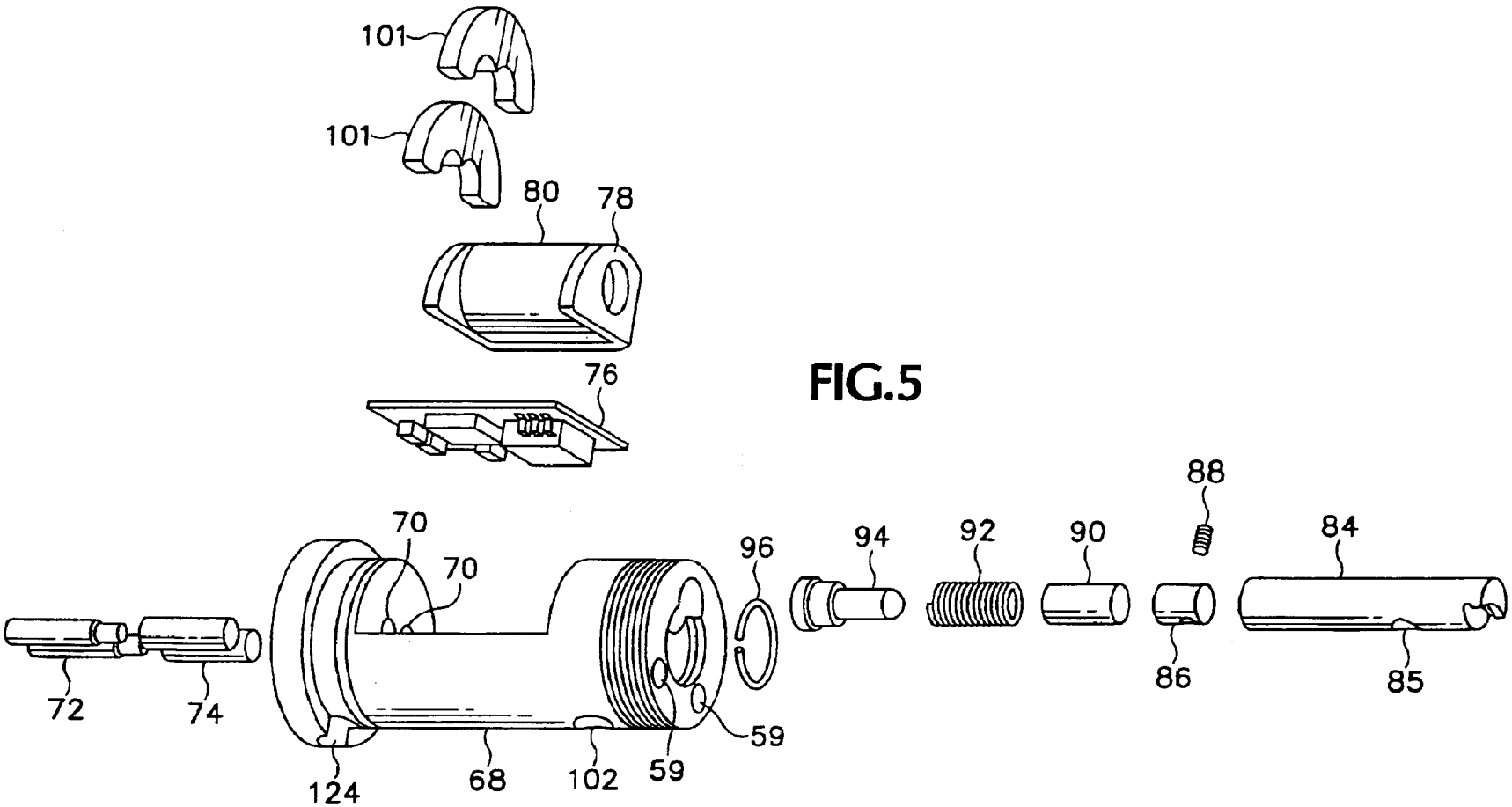
FIG. 5 is an exploded assembly view of an exemplary cylinder.

Referring now to the figures, wherein like numerals refer to like elements, FIGS. 1, 2 and 3 show an exemplary electronic locking system 10, which consists of a lock 12 and key 18. The lock 12 has a cylinder 14 that rotates within a shell 16. A bolt 20 (shown in phantom lines) is attached to the rear of the lock 12. In operation, the key 18 engages the lock 12 as shown in FIG. 3. The key 18 and lock 12 communicate electronically, so that when an authorized key 18 engages the lock 12, the cylinder 14 may be rotated within the shell 16. Rotation of the cylinder 14 causes movement of the bolt 20, enabling opening of the device that has been locked. For example, where the electronic locking system 10 is used with a desk drawer, rotation of the cylinder 14 would move the bolt 20 to a position wherein the desk drawer could be opened. The electronic locking system 10 may be used in any application where a lock would be desired, such as with doors, windows, cabinets, desks, filing cabinets, etc. The electronic locking system 10 may be used with any conventional bolt or equivalent apparatus used to secure the item to be locked.

The Key

Figure 11:
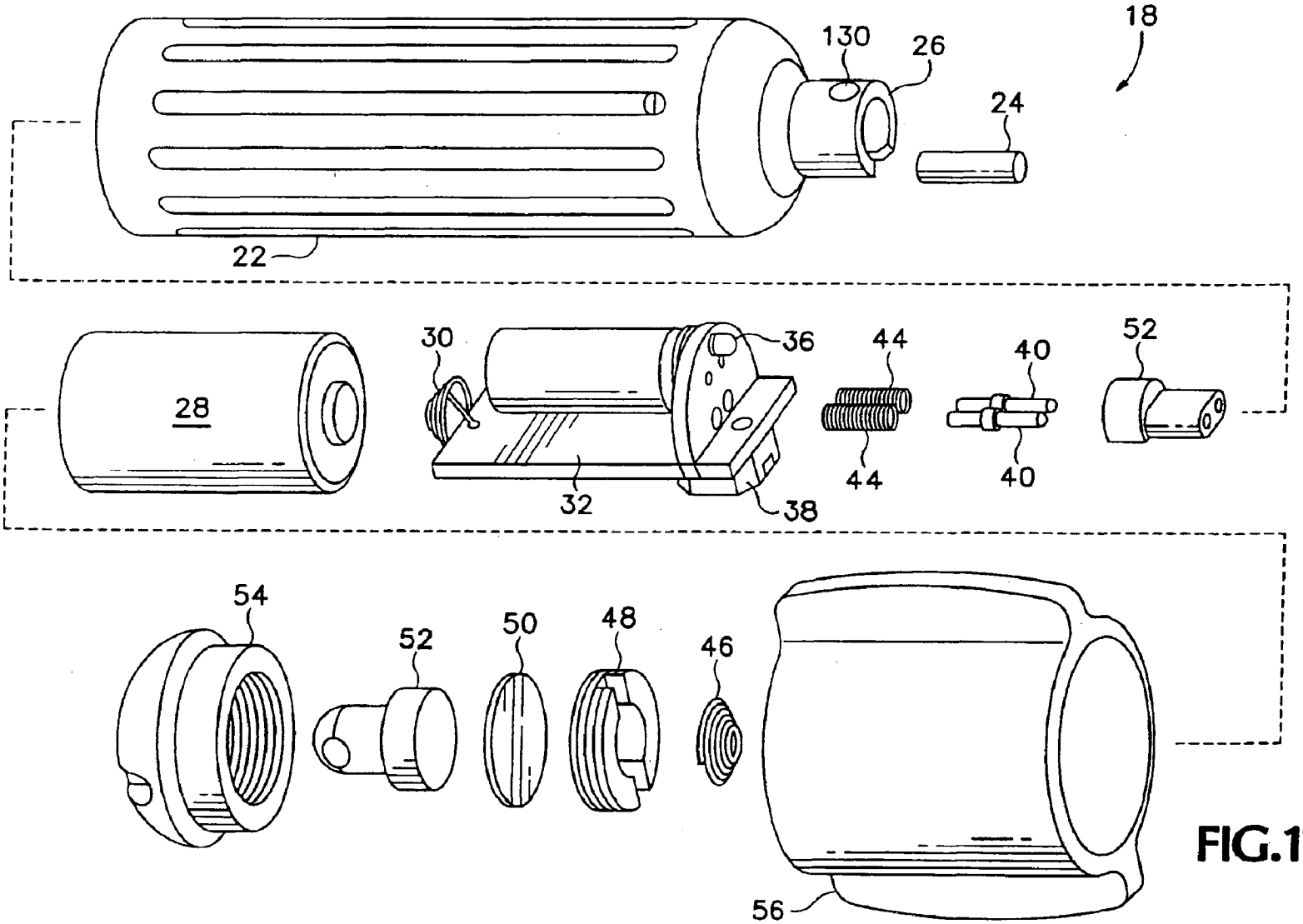
FIG. 11 is an exploded assembly view of an exemplary key.

FIGS. 2 and 11 show an exemplary embodiment of a key 18 of the present invention. The key 18 has an external housing 22 containing the components of the key 18. The key 18 has a lock engaging rod 24 at the front end of the key 18. The key 18 also has an annular neck 26 that defines a bore 130 opposite the rod 24. Inside the housing 22 is a battery 28, battery spring 30, and printed circuit board 32. Mounted on the printed circuit board is a microprocessor, LED 36 and beeper 38. Electrical contact is made between the key 18 and the lock 12 through the key pins 40, which are electrically insulated by the insulator 42. Coil springs 44 urge the pins 40 forward and into engagement with the lock 12. The key pins 40 are electrically connected to the microprocessor and battery 28.

The assembled insulator 42, pins 40, printed circuit board 32, and battery 28 are held snugly within the housing 22 by use of the spring 46 and plug 48. A gasket 50 seals the key 18, which is pressed against the plug by the post 52. A cap 54 seals the housing 22. A torque amplifier 56 fits around the housing 22, so that the key 18 may be easily gripped and turned.

The essential components of the key 18 are a power supply, such as battery 28, and microprocessor, for communicating with the lock 12. The mechanical assembly and electrical connections may be constructed as desired. Thus for example, while a rod 24 and annular neck 26 are shown, other mechanical arrangements could be used to allow the key 18 to engage the lock 12 so as to rotate the lock, such as a square peg.

The Lock

Figure 6:
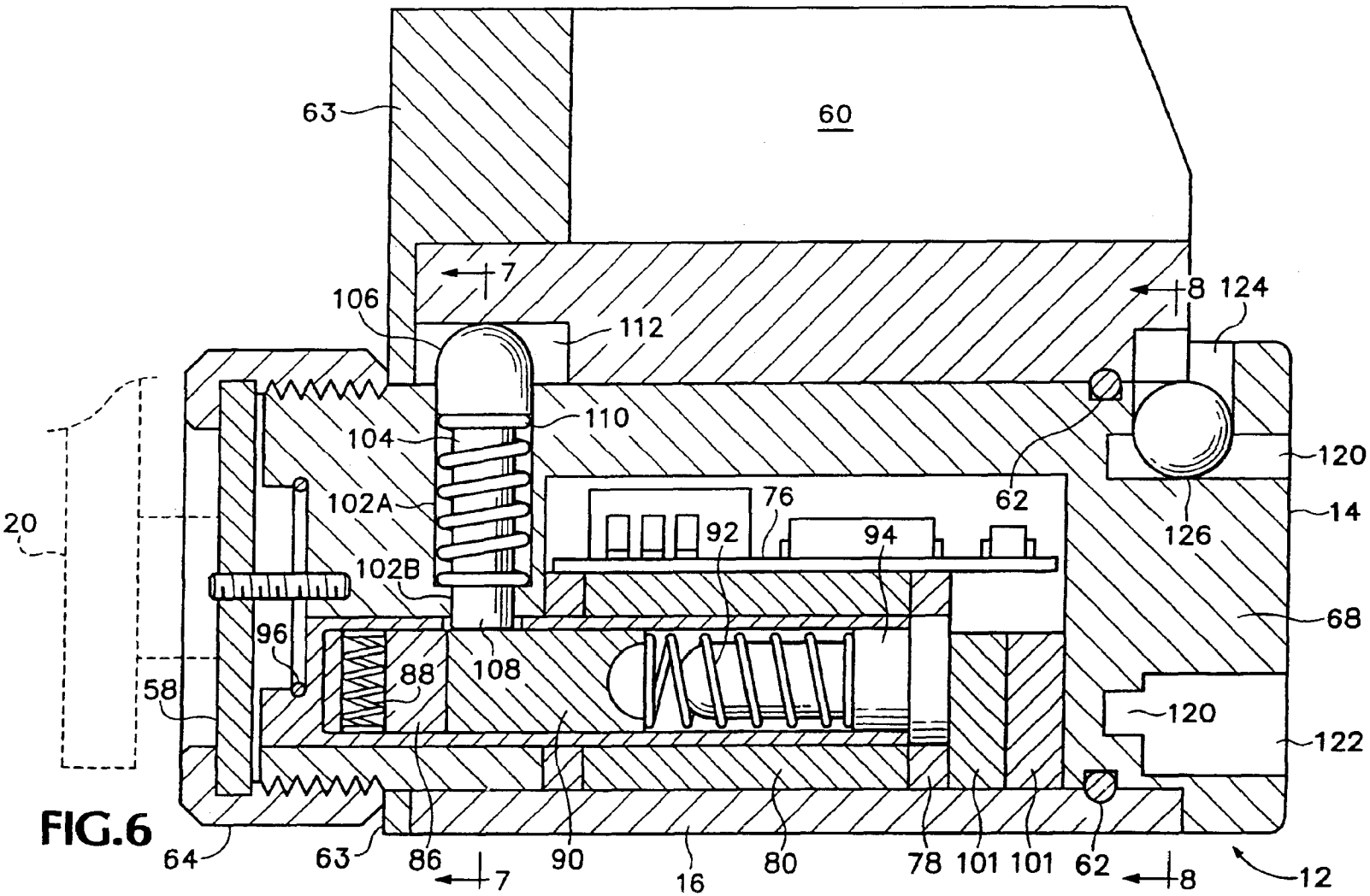
FIG. 6 is a cross-section of the lock of FIG. 1 taken along a longitudinal line bisecting the cylinder.

FIGS. 1, and 4–6 illustrate an exemplary lock 12. FIG. 6 is a cross-section taken along a longitudinal line bisecting the lock 12. The lock 12 is comprised of a cylinder 14 and a shell 16. The lock 12 may be sized so as to replace conventional mechanical cylinder locks. A tail piece 58 (see FIG. 6) is attached to the end of the cylinder 14 with bolts or screws. A pair of bores 59 at the end of the cylinder 14 receive the bolts or screws for attaching the tail piece. (See FIG. 5) The tail piece 58 is connected to a bolt 20, or other conventional locking device, which interferes with movement of the item to be locked. For example, where the lock 12 is used to lock a desk drawer, the bolt 20 would prevent movement of the desk drawer relative to the desk. The shell 16 may be made from any conventional material, such as brass, and includes a bible 60 projecting away from the cylindrical portion of the shell 16. The bible 60 fits within a slot in the device to be locked, such as a desk drawer, to prevent rotation of the shell 16 with respect to the device. An o-ring 62 and a back seal 63 are used to seal the inside of the shell 16 to prevent dirt and other contaminants from entering the inside of the shell 16 and damaging the components of the lock 12. A threaded retainer 64 is threadably attached to a threaded rear portion 66 of the cylinder 14. The tension between the cylinder 14 and the shell 16 may be adjusted by tightening the retainer 64, thus controlling the ease with which the cylinder 14 may be rotated within shell 16.

The cylinder 14 is comprised of a body 68 to which is mounted the various components of the cylinder 14. The front portion of the body 68 has two bores 70, each of which contains an electrical contact 72. The contacts 72 are insulated from the body 68 by insulators 74. The electrical contacts 72 receive the pins 40 to provide the electrical connection between the lock 12 and key 18, so that the key 18 may provide power to the lock 12 and so that the key 18 and lock 12 can communicate with one another.

A printed circuit board 76 is mounted at the center of the body 68. The printed circuit board 76 includes the lock microprocessor and memory for the lock 12. The printed circuit board 76 is electrically connected to the electrical contacts 72.

A solenoid assembly is also mounted in the body 68. The solenoid assembly includes a frame 78 to which is mounted a solenoid coil 80. The coil 80 is aligned with a bore 82 at the rear portion of the body 68. The solenoid assembly also includes a tube 84 containing a tamper element 86, tamper spring 88, solenoid plunger 90, solenoid spring 92 and solenoid pole 94. The assembled tube 84 is inserted into the bore 82 so that the lower portion of the tube 84 and solenoid pole 94 are located within the solenoid coil 80. The tube 84 is made of brass or some other non-ferrous material. The tube 84 is retained inside of the bore 82 through the use of a lock ring 96. The lock ring 96 fits within an annular groove 98 at the rear portion of the body 68 and another groove 100 at the end of the tube 84. Drill guards 101 are mounted between the front portion of the body 68 and the solenoid frame 78 to protect the solenoid assembly from being drilled out.

The body 68 also includes a bore 102 that is perpendicular to and in communication with bore 82 of the body 68 and bore 85 of the tube 84. Referring especially to FIG. 6, housed within the bore 102 is a pin 104 having a rounded head portion 106 and a lower rod portion 108 having a smaller diameter than the head portion 106. The bore 102 has an upper portion 102A that is sized so as to receive the rounded head portion 106, and a lower portion 102B having a smaller diameter sized to receive the lower rod portion 108. A spring 110 fits within the upper bore portion 102A. The spring 110 is wider than the lower bore portion 102B, so that the spring 110 is compressed by movement of the rounded head portion 106 of the pin 104 as the pin 104 moves inside the bore 102. Thus, the spring 110 urges the pin 104 out of the bore 102.

Figure 7:
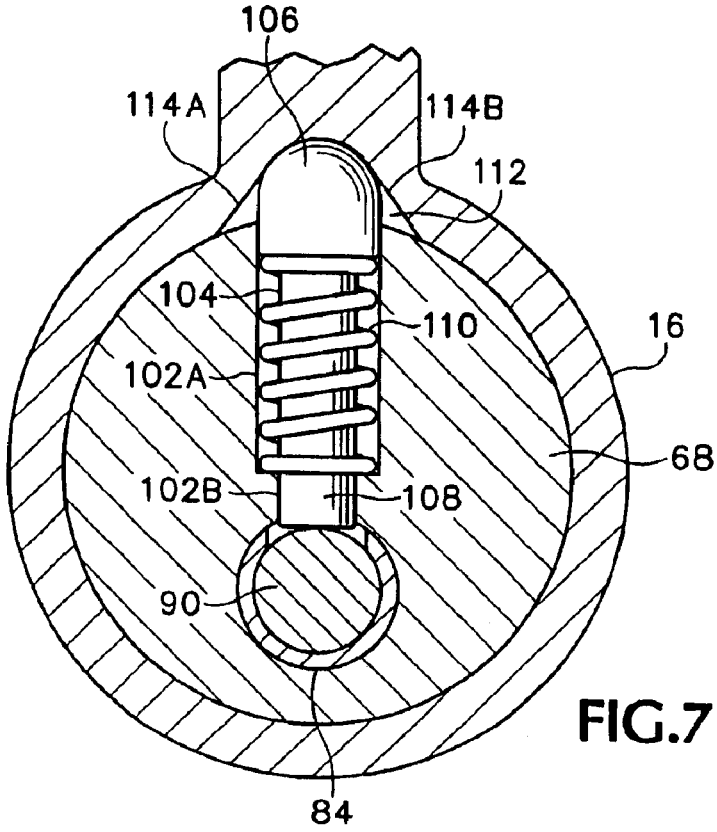
FIG. 7 is a cross-section of the lock taken along the line 7—7 of FIG. 6.

Referring now especially to FIG. 7, the shell 16 defines a cavity 112 that communicates with the bore 102 when the cylinder 14 is in the shell 16 and located in the home, or locked, position. The cavity 112 is defined by a pair of opposing cam surfaces 114A and 114B. The cavity 112 is large enough to receive at least a portion of the head portion 106 of the pin 104.

Collectively, the solenoid assembly, pin 104, and spring 110 comprise a locking mechanism used to prevent or interfere with rotation of the cylinder 14 with respect to the shell 16. FIG. 6 shows the lock 12 in a locked condition. In the locked condition, no power is supplied to the solenoid coil 80. The solenoid spring 92 urges the plunger 90 away from the pole 94. The plunger 90 thus occupies the space in the tube 84 beneath the bore 85. The rounded head portion 106 of the pin 104 is in the cavity 112 of the shell 16. If the cylinder 14 is rotated with respect to the shell 16, the rounded head portion 106 of the pin 104 engages one of the cam surfaces 114A or 114B. The cam surface 114A or 114B urges the rounded head portion 106 downward toward the bore 102. However, because the plunger 90 occupies the space beneath the pin 104, the rounded head portion 106 is prevented from moving completely into the bore 102. Thus, in the locked condition, the cylinder 14 is unable to rotate with respect to the shell 16 due to the engagement of the rounded head portion 106 of the pin 104 with one of the cam surfaces 114A and 114B.

The use of a lock member such as the pin 104 and an interfering member such as a solenoid plunger 90 provides the advantage of using a two-part system so that the lock member may be designed to withstand large primary forces, while the interfering member is not subjected to large direct forces.

Figures 9, 9A:
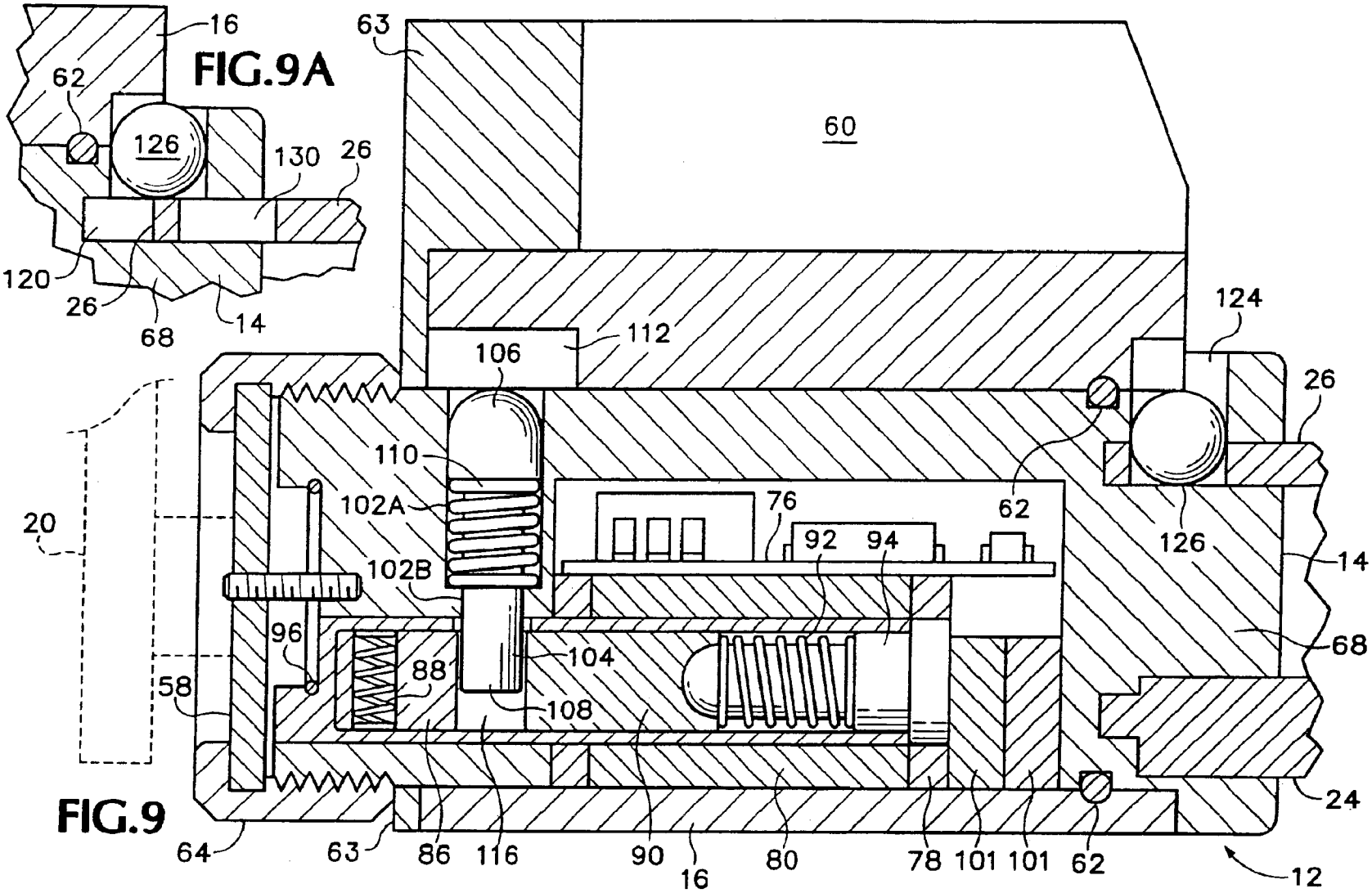
FIG. 9 is similar to FIG. 6, except that the electronic lock has been opened.
FIG. 9A shows a detail view of the key retention mechanism.

FIG. 9 illustrates the electronic lock 10 in an open condition. Power is supplied to the solenoid coil 80. In response, the solenoid plunger 90 is retracted into the solenoid coil 80 and into contact with the pole 94. Movement of the plunger 90 inside of the tube 84 creates an opening 116 within the tube 84 in communication with the bore 85. This opening 116 is large enough to receive a portion of the lower rod portion 108 of the pin 104. Thus, when the cylinder 14 is rotated with respect to the shell 16, and the rounded head portion 106 of the pin 104 engages one of the cam surfaces 114A or 114B, the lower rod portion 108 is urged into the opening 116. For example, if the cylinder 14 is rotated so that the head portion 106 engages the cam surface 114A, the cam surface 114A will cause the pin 104 to compress the spring 110 so that the head portion 106 is completely inside bore 102 and the lower rod portion 108 is partially inside the opening 116. The cylinder 14 is thus free to rotate with respect to the shell 16.

This locking mechanism thus provides a significant advantage to the electronic locking system 10. All of the locking components of the lock 12, e.g. the microprocessor and locking mechanism, are housed within the cylinder 14. Thus, each of these components is completely housed within the cylinder 14 when the cylinder 14 rotates with respect to the shell 16. This provides several advantages. The lock 12 can be relatively small, and can be sized so as to replace conventional mechanical cylinder locks. The lock also does not require a power supply in the lock or external wiring to provide power. In addition, in the event an installed lock 12 fails, the cylinder portion 14 of the lock 12 may be replaced without replacing the shell 16.

Alternatively, other mechanical devices can be used to provide a locking mechanism. Instead of using a pin 104, other lock members could be used having different shapes, such as bars, latches, or discs. The lock member may move in other ways. For example, the lock member may be pivoted about an axis so that a portion, when pivoted, interferes with rotation of the cylinder.

In the embodiment illustrated in the figures, the front face of the cylinder defines an annular groove 120 that receives the neck 26 of the key 18. On one side of the annular groove 120, the cylinder defines a bore 122 in communication with the annular groove 120. The bore 122 is capable of receiving the rod 24 of the key 18. The mating engagement of the bore 122 and the rod 24 ensure that the key 18 is properly aligned with the cylinder 14. In addition, the rod 24, when in mating engagement with the bore 122, allows the key 18 to transfer torque to the cylinder 14, minimizing the torque applied through the key pins 40.

Figure 10:
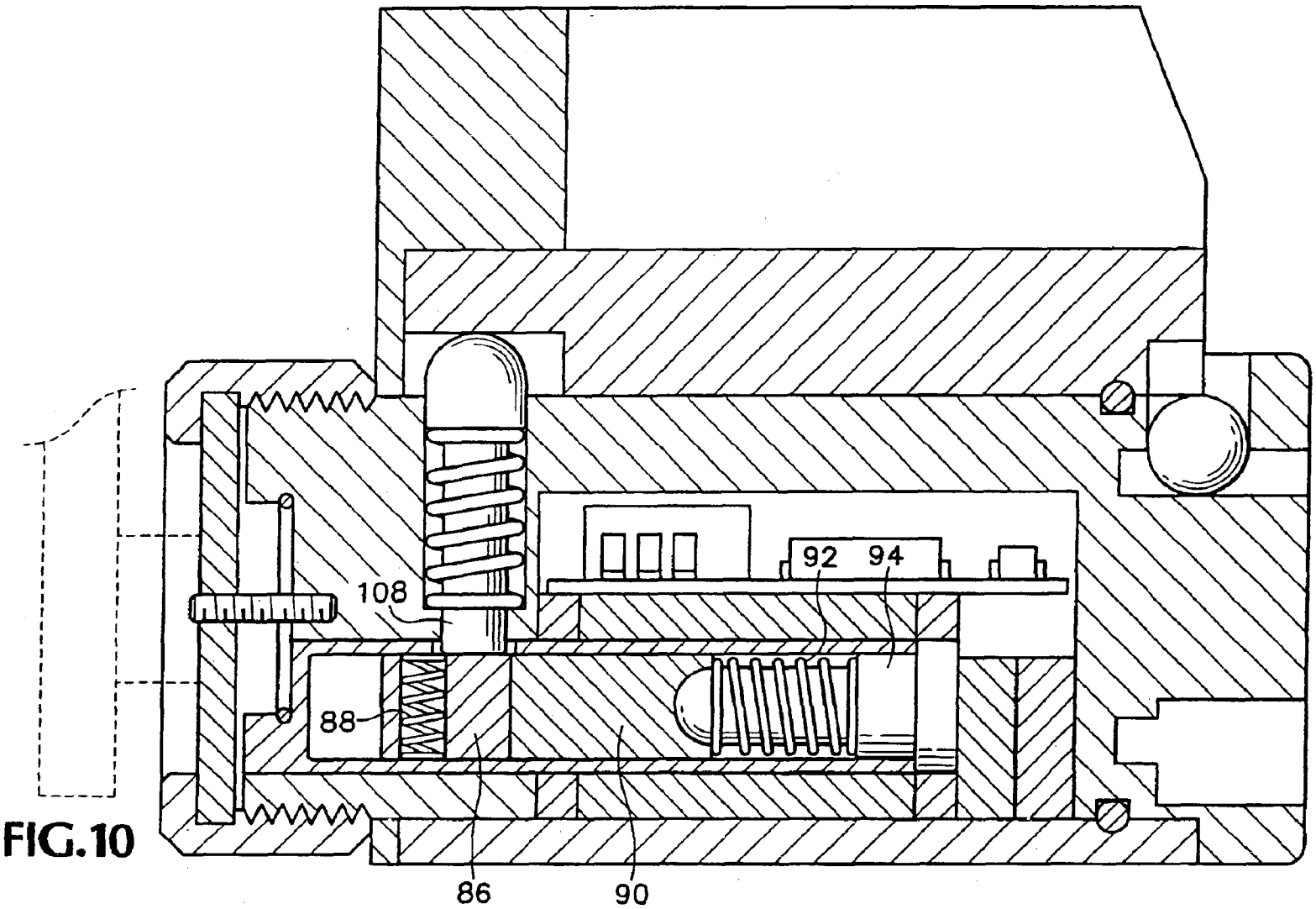
FIG. 10 is similar to FIG. 6, except that a large force has been applied to the face of the lock.

In a separate aspect of the invention, the electronic locking system 10 also has a unique anti-tamper mechanism. In normal operation, the tamper element 86 resides at the closed end of the tube 84. A tamper spring 88 within the tamper element 86 frictionally engages the interior wall of the tube 84, so as to resist movement of the tamper element 86 within the tube 84. Thus, as illustrated in FIG. 9, when power is supplied to the solenoid coil 80, and the plunger 90 is retracted, the tamper element 86 does not move. Thus, the tamper element 86 does not interfere with inward movement of the pin 104 into the opening 116. However, as illustrated in FIG. 10, in the event of a sharp impulse force being applied to the front of the lock 12, the tamper element 86 prevents the cylinder 14 from being rotated. A sharp force applied to the lock 12 may cause the plunger 90 to be momentarily retracted inside of the coil 80 by inertial forces. The same inertial forces cause the tamper element 86 to also move longitudinally with respect to the tube 84. The tamper element 86 thus occupies the space beneath the bore 85 of the tube 84, preventing the pin 104 from being pushed into the bore 102 by rotation of the cylinder 14. Once the spring 92 overcomes the inertial forces which resulted from the sharp impact, both the plunger 90 and tamper element 86 are returned to their normal positions when in the locked condition as shown in FIG. 6. Thus, the locking system 10 of the present invention has the advantage of preventing the lock 12 from being opened by merely striking the lock 12 with a sharp blow.

In another separate aspect of the invention, the lock 12 also has a biasing mechanism that urges the lock toward a home position in order to provide for increased reliability of the locking system 10. In the embodiment shown in the figures, the "home position" of the lock 12 is defined by the cavity 112. The cam surfaces 114A and 114B meet at an apex 118. When the bore 102 of the cylinder 14 is aligned with the apex 118, the cylinder 14 is in the home position. In the absence of external torque applied to the cylinder 14, the cylinder 14 will naturally return to the home position once the head portion 106 begins to enter the cavity 112. The spring 110 urges the head portion 106 against the cam surfaces 114A or 114B. As the head portion 106 engages one of these cam surfaces 114A, 114B, the cam surface 114A or 114B urges the head portion 106 toward the apex 118, and consequently the cylinder 14 toward the home position. Once the head portion 106 reaches the apex 118, it is at an equilibrium point, which is the home position. Likewise, when the cylinder 14 is rotated away from the home position, the biasing mechanism urges the cylinder 14 to return to the home position. This biasing mechanism provides additional advantages to the locking system 10. When rotating the cylinder 14 back toward the home position in order to lock the lock 12, the user of the locking system 10 is able to determine when the cylinder 14 has returned to the home position based on the changes in resistance to movement caused by compression of the spring 110. When the home position has been located, the user may safely remove the key, knowing that the cylinder is in the correct position to be locked.

While the embodiment illustrated in the figures combines the locking mechanism with the biasing mechanism, the biasing mechanism could be separate from the locking mechanism. Thus, the biasing mechanism could be a separate mechanical member urged by a spring, elastomer or other biasing device into engagement with the shell. Alternatively, the biasing mechanism could reside inside the shell and be urged into engagement with the cylinder. For example, the biasing mechanism may be comprised of a spring and ball-bearing housed within a bore in the shell. In such an alternative embodiment, the ball bearing may engage a dimple in the exterior surface of the cylinder, and the dimple defines the home position.

In another separate aspect of the invention, the locking system 10 provides a key retention mechanism. The cylinder 14 also has a bore 124 that is perpendicular to the longitudinal axis of the cylinder 14 and is in communication with the annular groove 120. The bore 124 receives a ball bearing 126. The shell 16 defines a cavity 128 that is in communication with the bore 124 when the cylinder 14 is in the home position. The neck 26 also has a bore 130 that is opposite the rod 24. When the neck 26 is inserted into the annular groove 120, the bore 130 is aligned with the bore 124. The bore 130 is sized so that the ball bearing 126 may be received within the bore 130. When the neck 26 is first inserted into the annular groove 120, the ball bearing 126 is first pushed up into the cavity 128. However, once the neck 26 is fully inserted into the groove 120, the ball bearing drops back down inside the bore 124 and inside the bore 130 in the neck 26. When the cylinder 14 is rotated, the ball bearing 126 sits completely within the bore 124, and thus is housed within the cylinder 14 as the cylinder 14 is rotated. The ball bearing 126 prevents the key 18 from being withdrawn from the cylinder 14 once the cylinder 14 is rotated past the home position. The interior surface of the shell 16 prevents the ball bearing 126 from moving upward in the bore 124, thus preventing the neck 26 from being withdrawn from the groove 120. The only position in which the key 18 may be disengaged from the cylinder 14 is when the cylinder 14 is returned to the home position, so that the ball bearing 126 may be pushed up into the cavity 128, thus allowing the neck 26 to be withdrawn from the groove 120. Thus, the key retention mechanism provides the advantage of preventing the key 18 from being withdrawn from the lock 12 unless the cylinder 14 is returned to the home position. This ensures that the cylinder 14 is aligned properly so that the locking mechanism may be locked so as to prevent or interfere with rotation of the cylinder 14 with respect to the shell 16. Alternatively, other key retention mechanisms could be employed to retain the key 18 in the cylinder 14 when the cylinder 14 is rotated with respect to the shell 16. For example, the key could have a projecting tab which is received within a slot having an opening sized to receive the tab, allowing the key to rotate but preventing removal of the key except when the tab is aligned with the opening.

In sum, the present invention provides several advantages. By housing the operative components of the locking mechanism entirely within the cylinder, a locking system may be manufactured to fit within a very small volume. Thus, the electronic lock may be used to replace conventional mechanical cylinder locks. In addition, in the event an installed lock fails, the cylinder may be replaced without replacing the entire lock. The present invention also does not require the use of a power supply within the lock itself. Thus, the lock can be smaller because it does not contain a power supply, and is not susceptible to corrosion resulting from a corroding battery. Nor does the lock require an external source of power from external wiring. The lock is thus simpler and easier to install.

Figure 8:
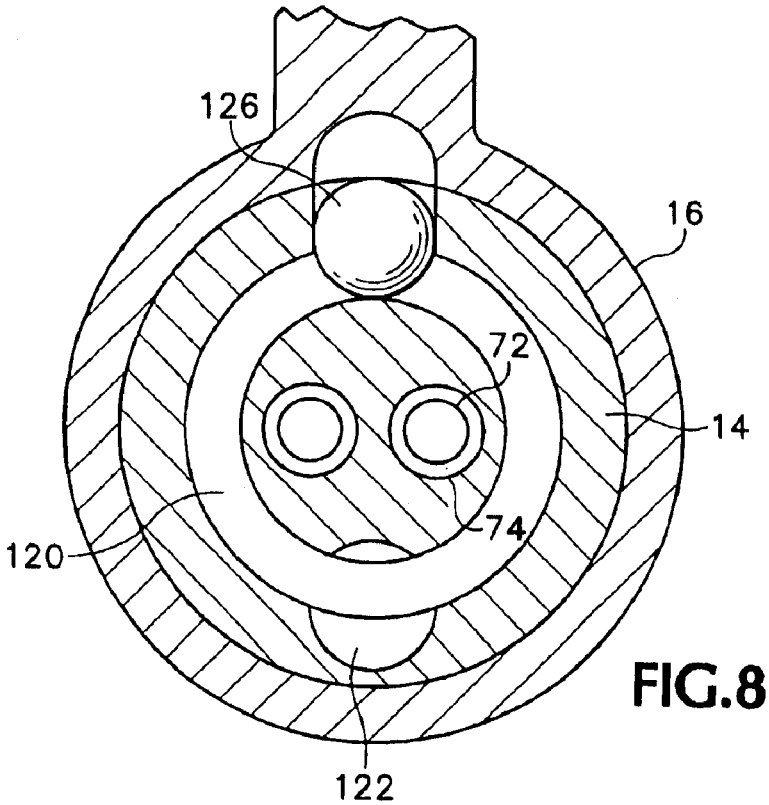
FIG. 8 is a cross-section of the lock taken along the line 8—8 of FIG. 6.
Figure 19:
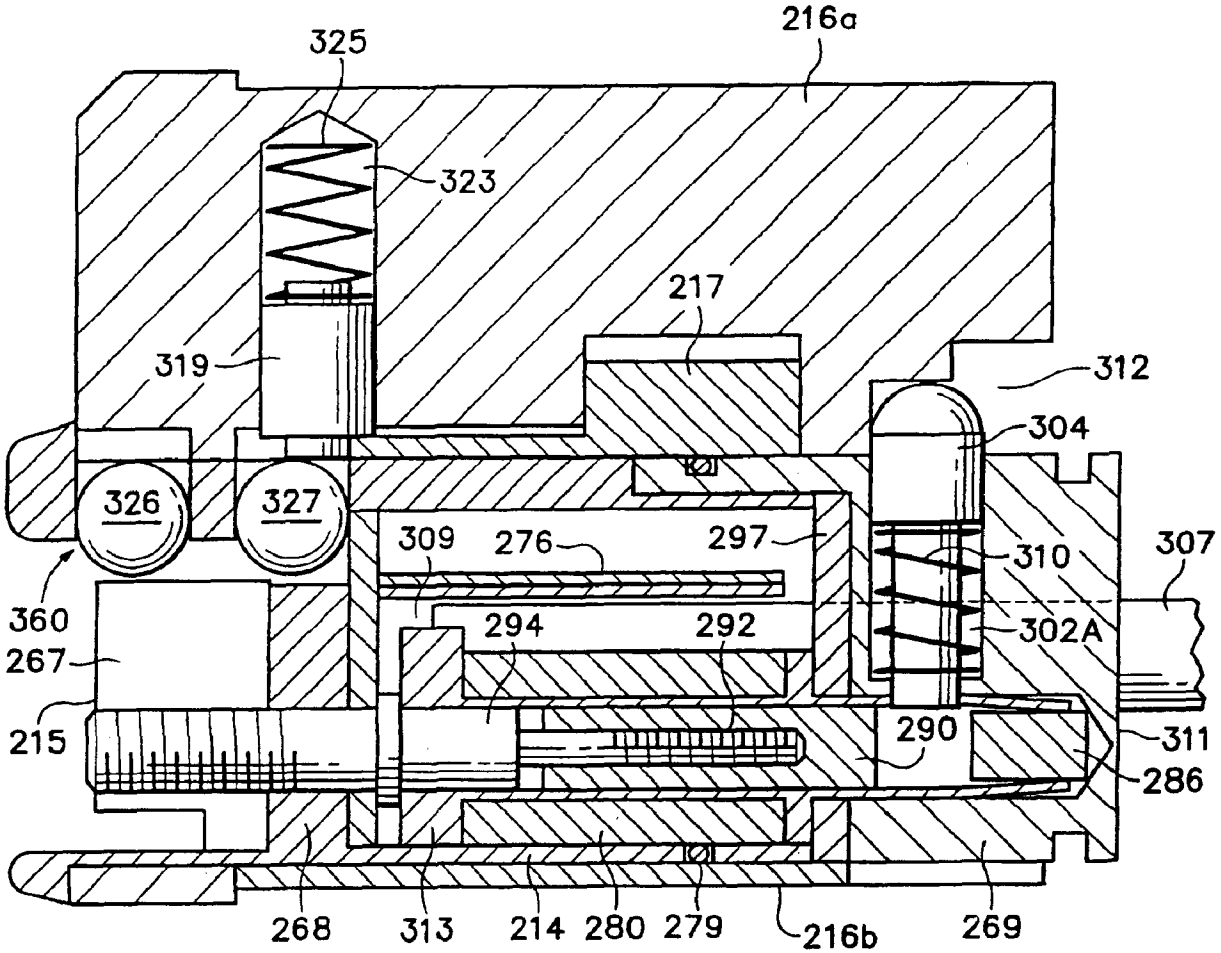
FIG. 19 is a cross-section taken along the line 19—19 of FIG. 17.
Figure 21:
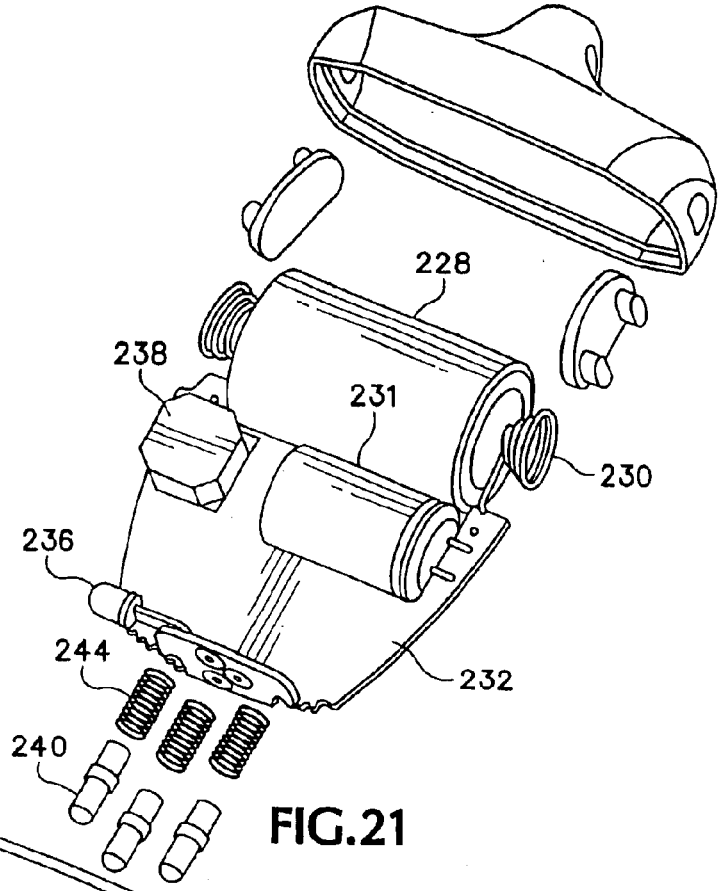
FIG. 21 is an assembly view of the key of FIG. 20.
Figure 20:
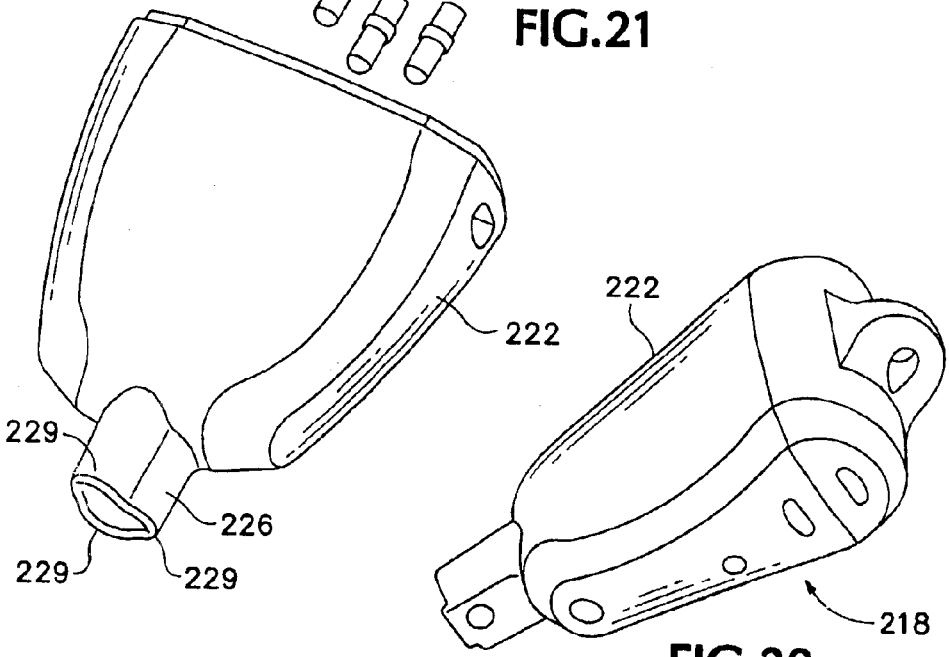
FIG. 20 is a perspective view of an exemplary key for use with the lock of FIG. 15.

FIGS. 15–21 illustrate a second embodiment of a locking system comprised of the lock 212 shown in FIGS. 15–19 and the key shown in FIGS. 20–21. The second embodiment shares many of the same features of the embodiment of FIGS. 1–9. The lock 212 is comprised of a cylinder 214 and a shell 216. The lock 212 is sized to replace conventional mechanical cylinder locks having a generally FIG. 8 cross-section, and which are generally referred to as "interchangeable core" or "replaceable core" locks. Such locks are described generally in U.S. Pat. Nos. 3,206,959 and 4,294,093.

The cylinder 214 is comprised of a front portion 268 and a rear portion 269. The front portion 268 and rear portion 269 are arranged longitudinally, interconnected for mutual rotation by mating engagement of longitudinally extending protrusions 268*b* and protrusions 269*b* spaced about the periphery, respectively, of the front portion and the rear portion, and connected together using a snap ring 279 which fits in the grooves 273 and 275 of the front portion and rear portion, respectively. The cylinder 214 is retained within the shell 216 by means of another split ring 219 which is attached to an annular groove 221 around the rear portion 289 (see FIGS. 16 and 17).

The front portion 268 has a nose 267 having two bores 270, each of which contains an electrical contact 272 surrounded by an insulator 274. Like the embodiment of FIGS. 1–9, the contacts 272 engage or contact the pins 240 from the key (see FIG. 21) to provide the electrical connection between the lock 212 and key 218, so that the key 218 may provide power to the lock 212 and so that the key 218 and lock 212 can communicate with one another.

A printed circuit board 276 is mounted within the cylinder 214. Like the embodiment of FIGS. 1–9, the printed circuit board 276 includes the lock microprocessor 277 and memory for the lock 212. The printed circuit board 276 is electrically connected to the electrical contacts 272.

A solenoid assembly is also mounted in the front portion 268. The solenoid assembly includes a solenoid coil 280. The solenoid assembly also includes a tube 284 containing a tamper element 286, solenoid plunger 290, solenoid spring 292 and solenoid pole 294. The tube 284 is inserted into the solenoid coil 280 so that the front portion of the tube 284 and solenoid pole 294 are located within the solenoid coil 280. The tube 284 is made of plastic. The solenoid pole 294 is threadably engaged with a bore 295 in the nose 267 and provides a ground contact for the key 218.

Like the embodiment of FIGS. 1–9, the rear portion 269 includes a bore 302 that is perpendicular to and in communication with the tube 284. Referring especially to FIG. 19, housed within the bore 302 is a pin 304 having a rounded head portion 306 and a lower rod portion 308 having a smaller diameter than the head portion 306. A spring 310 fits within the upper bore portion 302A. The pin 304 functions as a lock member just like the pin 104 of the embodiment of FIGS. 1–9.

Figure 16:
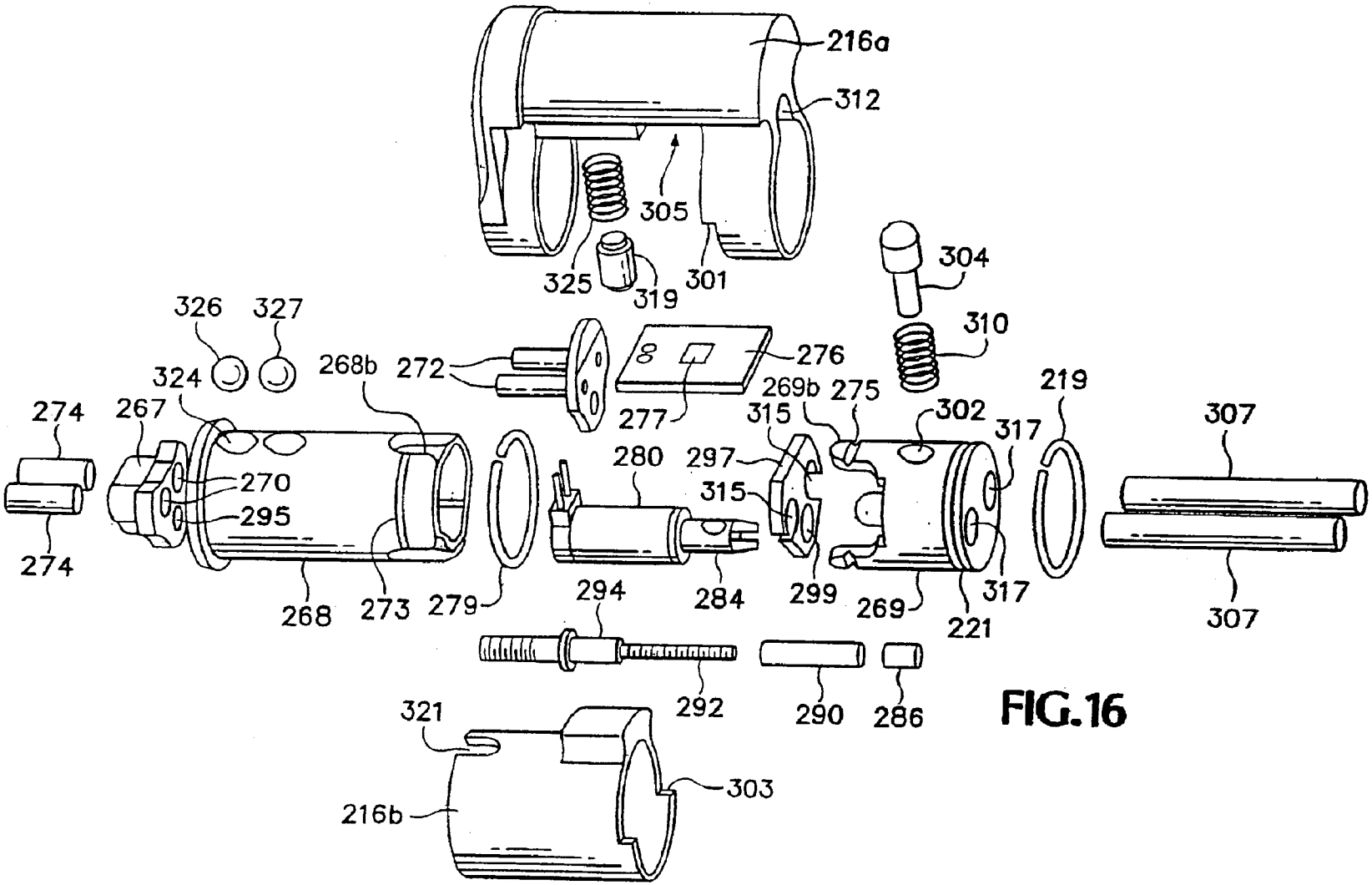
FIG. 16 is an assembly view of the lock of FIG. 15.

As shown in FIGS. 16 and 19, the shell 216 defines a cavity 312 that communicates with the bore 302 when the cylinder 214 is in the shell 216 and located in the home, or locked, position. The cavity 312 is defined by a pair of opposing cam surfaces (not shown) like those of the embodiment of FIGS. 1–9. The cavity 312 is large enough to receive at least a portion of the head portion 306 of the pin 304.

Collectively, the solenoid assembly, pin 304, and spring 310 comprise a locking mechanism used to prevent or interfere with rotation of the cylinder 214 with respect to the shell 216. The locking mechanism functions like the locking mechanism of the embodiment of FIGS. 1–9 to selectively allow rotation of the cylinder 214 with respect to the shell 216 in response to a signal from either the key 218 or the lock 212.

The lock 212 also has a key retention mechanism like that of the embodiment of FIGS. 1–9. As shown in FIG. 19, the cylinder 214 also has a bore 324 that is perpendicular to the longitudinal axis of the cylinder 214 and is in communication with the groove 320 around the nose 267 which receives a ball bearing 326.

The second embodiment of FIGS. 15–21 has an anti-magnetic feature that enables the lock 212 to resist opening in response to the application of a large magnetic field to the front face 215 of the cylinder 214. Referring now to FIGS. 16 and 19, the lock 212 includes a plate 297 located adjacent to the rear of the solenoid coil 280 and at the rear end of the front portion 268 of the cylinder 214. Both the plate 297 and the front portion 268 of the cylinder are formed from a ferromagnetic material, such as soft transformer steel. In addition, the nose 267 is formed of a ferromagnetic material. Collectively, the plate 297, front portion 268 of the cylinder, and nose 267 form a ferromagnetic enclosure. The rear portion 269 of the cylinder 214, however, is formed from a non-ferromagnetic material, such as brass.

The plate 297 has an opening 299 for receiving the solenoid plunger 290. The solenoid plunger 290 is also formed from a ferromagnetic material. In order for the solenoid plunger 290 to interfere with downward motion of the pin 304, at least a portion of the solenoid plunger 290 must extend past the plate 297 and outside of the ferromagnetic enclosure. Likewise, in order for the solenoid plunger 290 to allow downward movement of the pin 304, the solenoid plunger 290 must be retracted toward the interior of the enclosure.

Surprisingly, a ferromagnetic enclosure which at least partially encloses the solenoid plunger 290 allows the lock 212 to resist being opened in response to an externally applied magnetic field. In the absence of the plate 297, a large magnetic field applied externally to the face 215 of the cylinder would cause the solenoid plunger 290 to retract within the solenoid coil 280. It then would be possible to rotate the cylinder 214, thus opening the lock. However, when the plate 297 is present, the externally applied magnetic field causes the solenoid plunger 290 to be urged out of the ferromagnetic enclosure and into interfering engagement with downward movement of the pin 304. While not wishing to be bound by a particular theory, it is believed that a magnetic field is induced in the enclosure, such that the lowest energy state for the solenoid assembly is for the solenoid plunger 290 to be located at least partially outside of the enclosure. In any event, application of a large magnetic field causes the locking mechanism to resist rotation of the cylinder 212 with respect to the shell 216 by causing the solenoid plunger 290 to move outside the enclosure into a position to interfere with downward movement of the pin 304.

Because the application of a magnetic field urges the solenoid plunger 290 out of the enclosure, at least a portion of the solenoid plunger 290 is within the enclosure in order for the lock to be opened. Preferably, for the solenoid plunger 290 to be in a position so as not to interfere with downward movement of the pin 304, at least a major portion of the solenoid plunger 290 is within the enclosure, more preferably at least 75% of the solenoid plunger 290 is within the enclosure, and even more preferably at least 90% of the solenoid plunger 290 is within the enclosure. Requiring a greater portion of the solenoid plunger 290 to be within the enclosure in order for the solenoid plunger 290 to not interfere with downward movement of the pin 304 insures that a sufficient force will be exerted on the solenoid plunger 290 to urge it out of the enclosure in response to application of an external magnetic field.

Similarly, it is desired that the solenoid plunger 290 need only move a short distance longitudinally in response to the applied magnetic field in order to interfere with rotation of the cylinder 214. As shown in FIG. 19, the solenoid plunger 290 needs to only travel out of the enclosure a very short distance, less than 5% of the overall length of the solenoid plunger 290, in order to interfere with downward movement of the pin 304.

In another separate aspect of the invention, the lock embodiment of FIGS. 15–19 is capable of replacing conventional "interchangeable core" or "replaceable core" locks, such as those described in U.S. Pat. Nos. 3,206,959 and 4,294,093. Such locks are used in standard receptacles. The shell 216 is comprised of a stationary portion 216*a* and a rotatable portion 216*b*. The rotatable portion 216*b* has a lug 217. The rotatable portion 216*b* is mounted for limited rotation by means of the interlocking cutout portions 301 and 303 of the stationary portion 216*a* and rotatable portion 216*b*, respectively. The cutout portions 301 and 303 limit the degree of rotation of the rotatable portion 216*b* with respect to the stationary portion 216*a*.

The rotatable portion 216*b* is rotatable between a retaining position in which the lug protrudes from the side of the shell 216 (shown in FIG. 15) and a releasing position in which the lug 217 is received within a slot 305 in the stationary portion 216*a*, allowing the lock 212 to be withdrawn from the receptacle. Interchangeable core locks having this general external shape with a retaining lug have become a standard in the industry and are of advantage in that they can be readily removed from and replaced from standard receptacles, such as in a padlock or doorknob.

Figure 17:
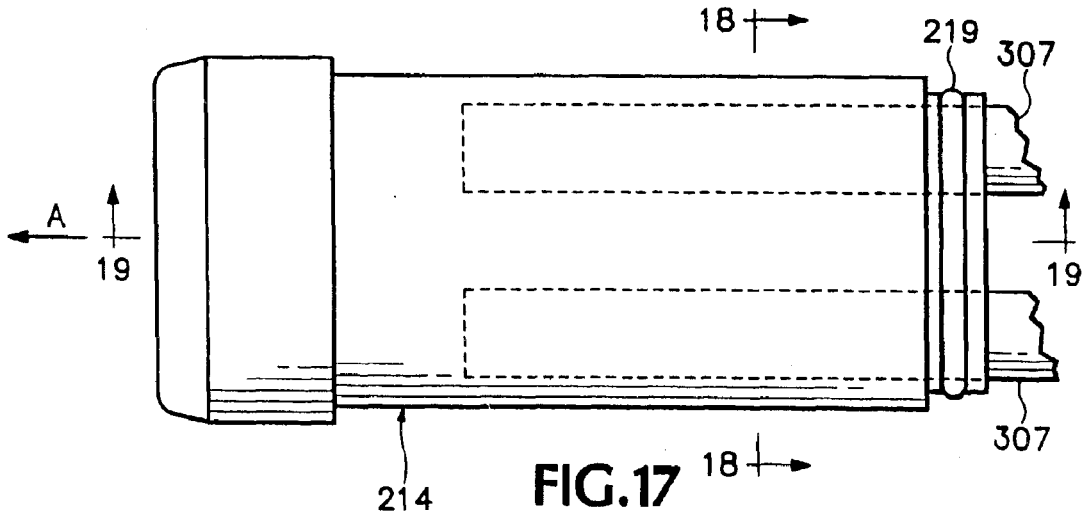
FIG. 17 is a plan view of the cylinder of the lock of FIG. 15.
Figure 18:
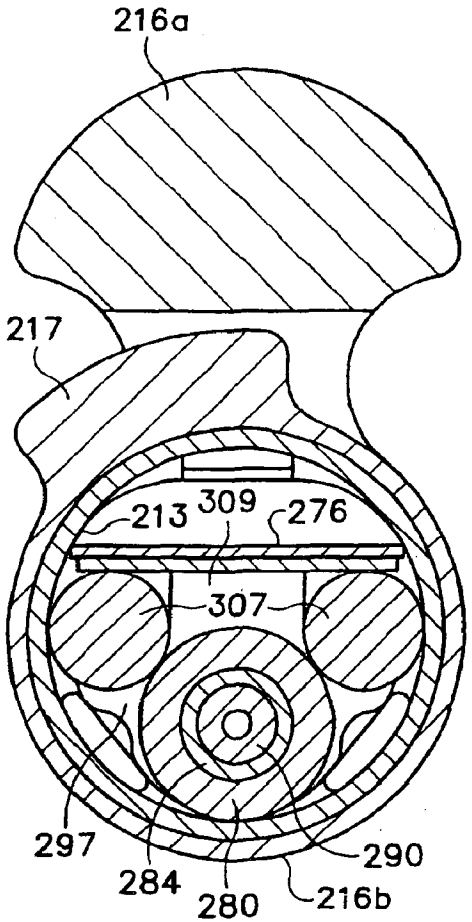
FIG. 18 is a cross-section taken along the line 18—18 of FIG. 17.

The difficulty with adapting an electronic lock to replace a conventional mechanical interchangeable core lock is that the lock is used in connection with a throw member having a pair of elongate throw pins 307. These throw pins 307 must be received within the cylinder 214, and occupy a substantial portion of the cylinder as shown in FIGS. 17 and 19, thus limiting the space available for the electrical components. The present invention solves the problem of accommodating the elongate throw pins 307 by arranging the solenoid assembly parallel to the longitudinal rotational axis A of the cylinder. As shown in FIGS. 18 and 19, the solenoid assembly is oriented longitudinally and parallel to the longitudinal axis A of the cylinder 214, so that the solenoid plunger 290 travels within the tube 284 in a longitudinal direction. Even though the solenoid assembly occupies a substantial portion of the cylinder 214, by aligning the solenoid assembly longitudinally within the cylinder, the cylinder has sufficient room to receive the elongate throw pins 307.

As shown in FIGS. 18 and 19, the printed circuit board 276 is mounted opposite and above the solenoid assembly. The interior surface 213 of the cylinder 214, printed circuit board 276, and solenoid assembly collectively define an elongate cavity 309 within the cylinder 214 for receiving the elongate throw pins 307. In use, the elongate throw pins 307 are received within the cavity 309. The cavity 309 extends from the plate 297 to about the front 313 of the solenoid assembly, as shown in FIG. 19. While the cylinder is shown and described as having an elongate cavity, the cavity 309 may be partitioned so as to comprise a pair of cavities within the interior of the cylinder, each for receiving the elongate pins.

The remainder of the lock 212 is similarly adapted to receive the throw pins 307. The plate 297 has a pair of openings 315 on either side for receiving the throw pins 307. Likewise, the rear portion 269 of the cylinder 214 has a pair of bores 317 for receiving the throw pins. Rotation of the cylinder 214 causes the rear portion 269 to engage the throw pins 307, thus transmitting rotation of the cylinder 214 to a secondary lock mechanism or throw member as is known in the art.

The lock 212 continues to achieve the advantage of utilizing a lock member such as a pin in conjunction with the solenoid plunger so that the solenoid plunger is not subject to large direct forces. To accommodate the throw pins 307, the pin 304 is perpendicular to the solenoid assembly and located in the rear portion 269 of the cylinder 214 above the tube 284. The pin 304 thus is located between the two bores 317 in the rear portion 269 of the cylinder which receive the throw pins 307.

Like the embodiment of FIGS. 1–9, all of the locking components of the lock 212, i.e., the microprocessor 277 and locking mechanism, are housed within the cylinder 214. Thus, each of these components is completely housed within the cylinder 214 when the cylinder 214 rotates with respect to the shell 216. Thus, this lock enjoys the advantage of relatively small size yet is capable of receiving a pair of elongate throw pins 307 so as to replace conventional mechanical interchangeable locks. In addition, in the event an installed lock 212 fails, the cylinder portion 214 of the lock 212 may be replaced without replacing the shell 216.

A special control key is used to rotate the rotatable portion 216*b* and retract the lug. The lock has a retaining mechanism for preventing rotation of the rotatable portion 216*b* comprising a pin 319 which engages a corresponding slot 321 in the rotatable portion 216*b*. The pin 319 is housed within a bore 323 in the stationary portion 216*a* and is urged downward by a spring 325. When the rotatable portion 216*b* is rotated so that the lug 217 is in a retaining position, the slot 321 is located under the bore 323 so that the pin 319 is urged into the slot 321, thus preventing rotation of the rotatable portion 216*b*.

To remove the pin 319 from the slot 321, a special control key is used having an elongate neck 226 which pushes the ball bearing 327 upward in the bore. This pushes the pin 319 out of engagement with the rotatable portion 216*b*, allowing the rotatable portion 216*b* to be rotated so as to retract the lug 217. The ball bearing 327 engages the side of the slot 321, thus allowing the control key to rotate the rotatable portion 216*b* of the shell.

The key of the second embodiment shown in FIGS. 20–21 is like that of the key 18 of the first embodiment, with the primary difference being the external shape of the housing 222. Inside the housing 222 is a battery 228, capacitor 231, battery spring 230, and printed circuit board 232. Mounted on the printed circuit board is a microprocessor, LED 236 and beeper 238. Electrical contact is made between the key 218 and the lock 212 through the key pins 240, which are electrically insulated by the housing. Coil springs 244 urge the pins 240 forward and into engagement with the lock 212. The key pins 240 are electrically connected to the microprocessor and battery 228.

The key 218 also has a neck 226, which is inserted into engagement with the front face of the cylinder 214. On one side of the neck 226 is a depression 227 for receiving the ball bearing 326. The neck 226 has three rounded lobes 229, each in the shape of an arc around each respective pin 240. The exterior shape of the neck 226 corresponds to the groove 320 around the nose 267 of the cylinder 214, so that the neck 226 can grasp the nose 267 and enable the key 218 to apply torque to the cylinder 214.

Key and Lock Communication

Figure 12:
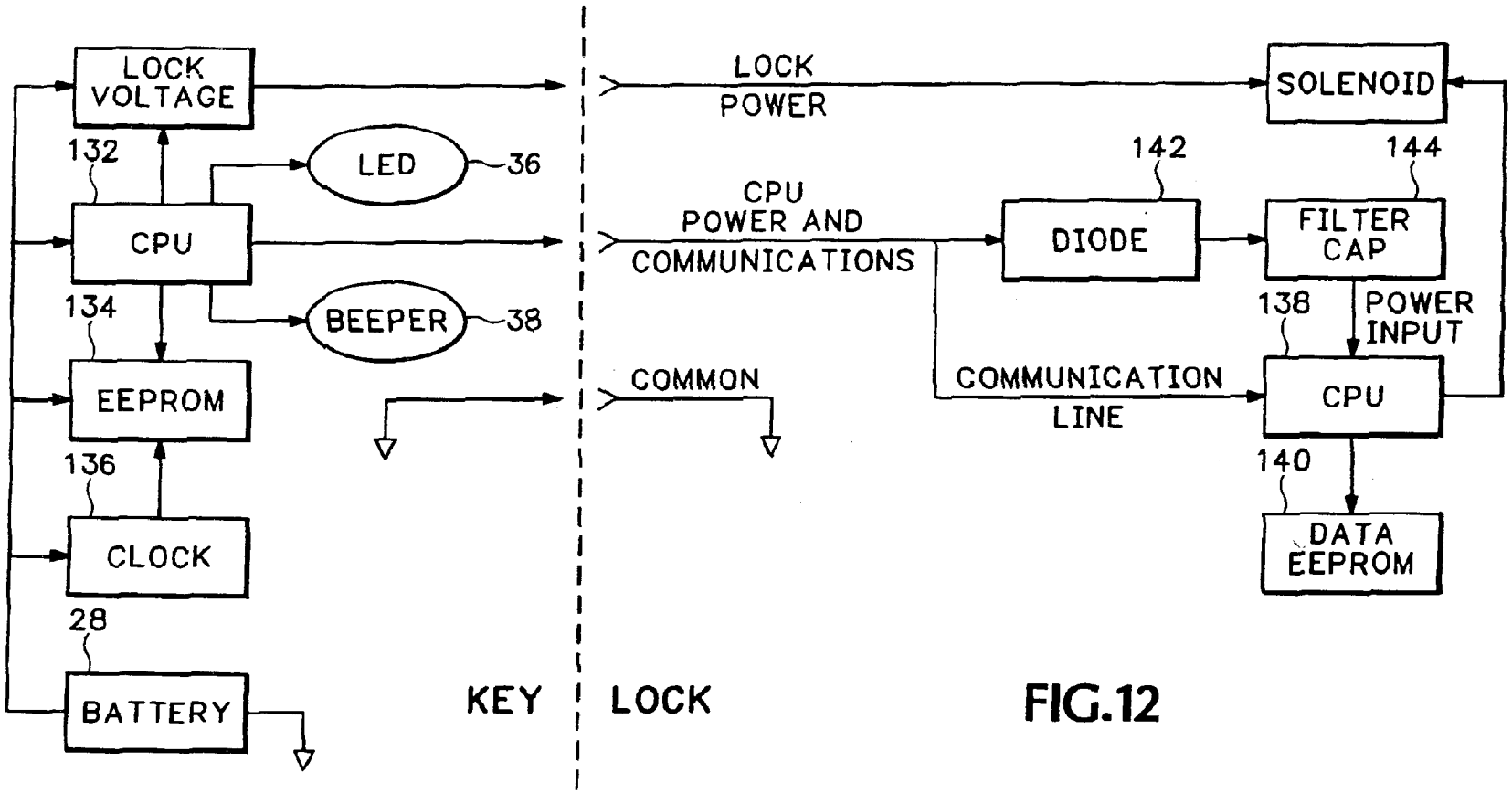
FIG. 12 is a block diagram of the electrical components of an exemplary key and lock.

Returning now to the embodiment of FIGS. 1–9, which is used to illustrate the key and lock communication, the key 18 and lock 12 communicate through the key pins 40 and the electrical contacts 72. Referring to FIG. 12, the key 18 has a microprocessor 132, a memory 134 in the form of Electronically Erasable Programmable Read Only Memory (EEPROM) which is connected to the microprocessor 132. Collectively, the microprocessor 132 and associated memory 134 comprise a computer system. The computer system which may be used in the present invention may be any device, whether a microprocessor alone or in combination with other processors and/or memory devices, which performs the functions described herein relating to the reading, writing, deleting, storing, and/or comparing of information relating to key identification codes, passwords and other data. The key 18 further optionally includes an LED 36, beeper 38, battery 28, and clock 136.

The lock 12 also has a microprocessor 138 and associated memory 140 in the form of EEPROM. Like the key, the microprocessor 138 and associated memory 140 comprise a computer system. Power and communications are delivered to the lock microprocessor 138 over a single line through one of the pins 40 and contact 72. The power passes through a diode 142 and filter capacitor 144 before entering the microprocessor 138. The lock may also optionally include an LED, beeper and/or clock.

Figure 13:
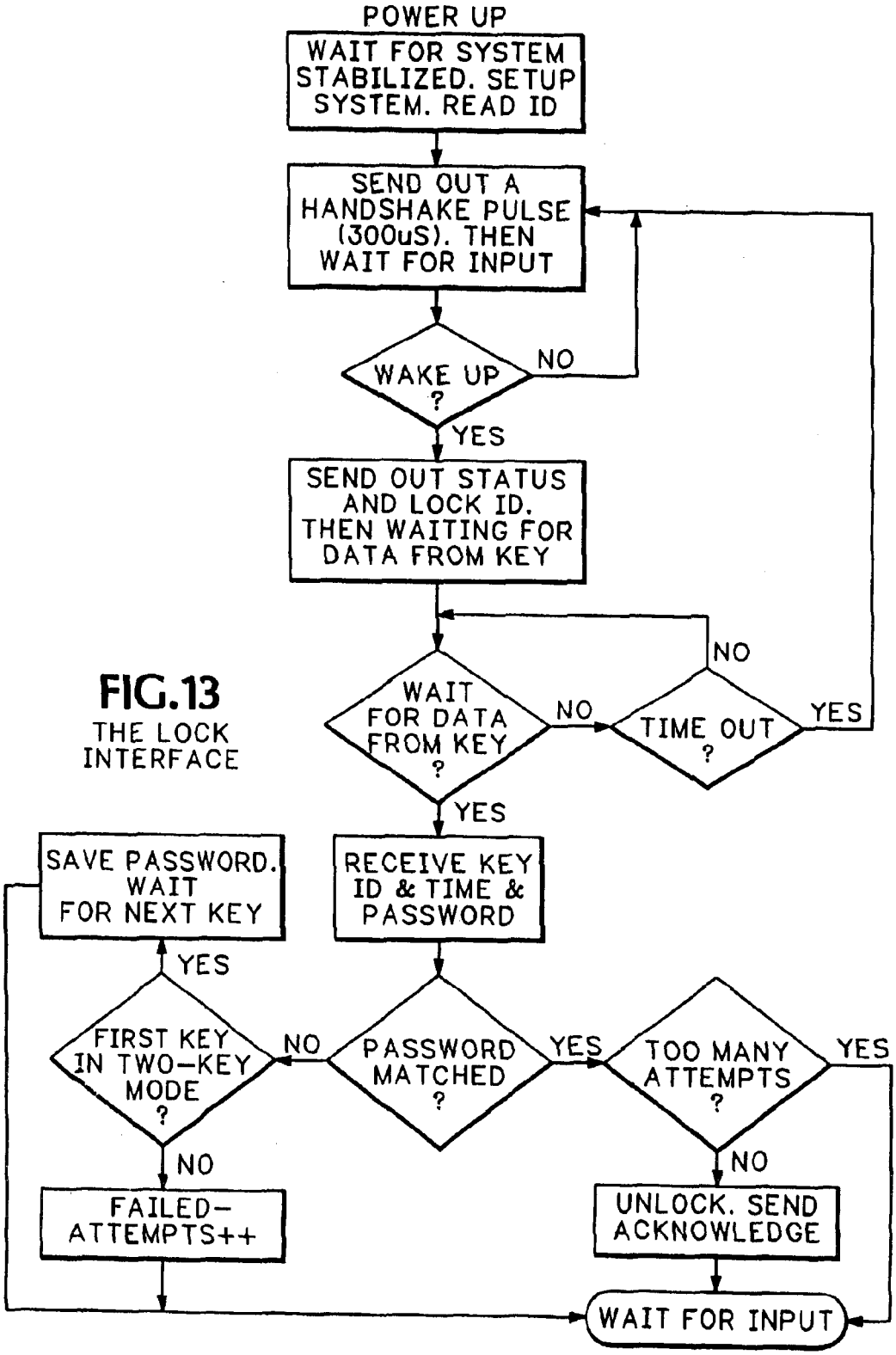
FIG. 13 is a flow diagram of the lock interface.
Figure 14:
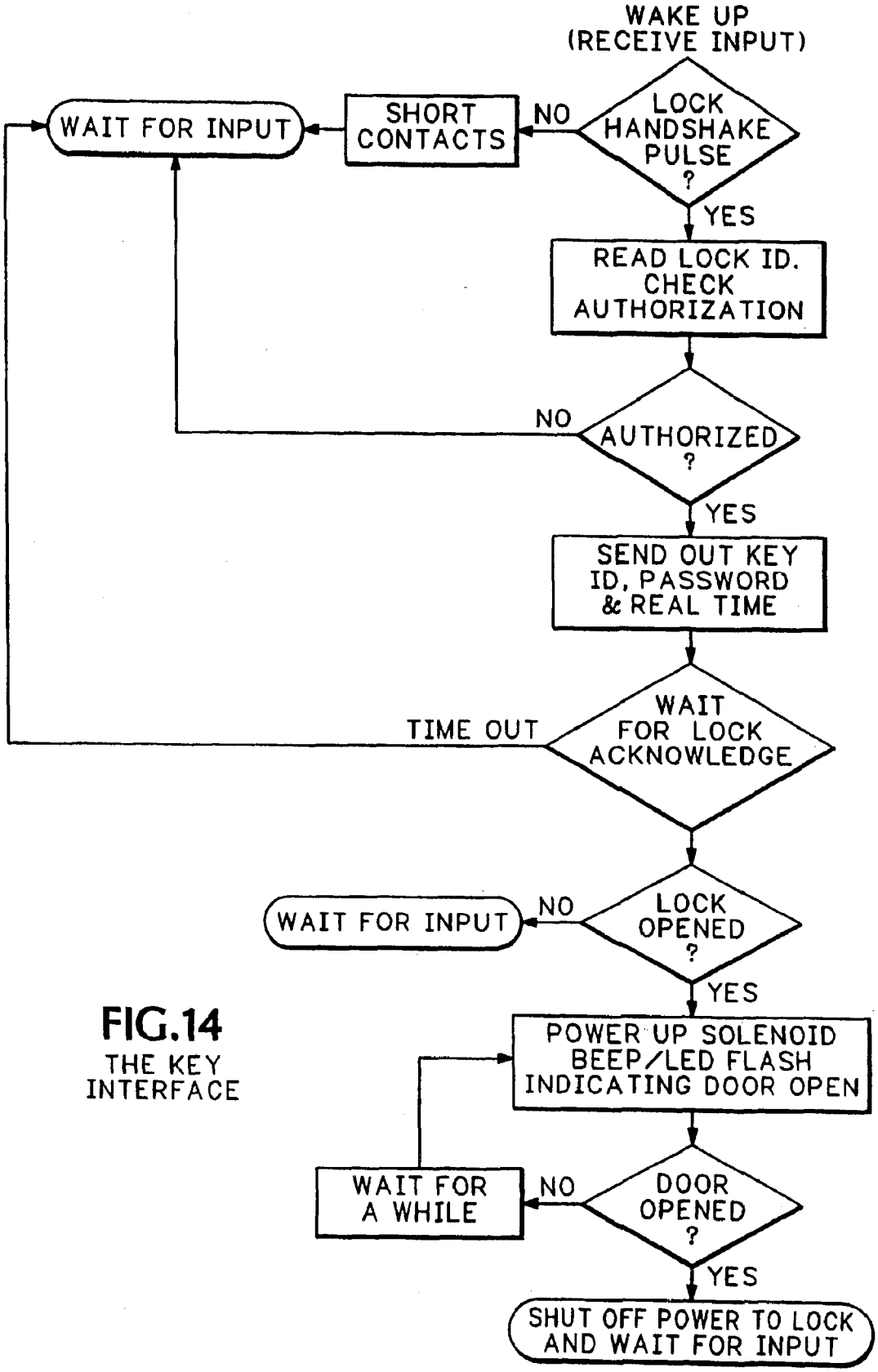
FIG. 14 is a flow diagram of the key interface.
Figure 15:
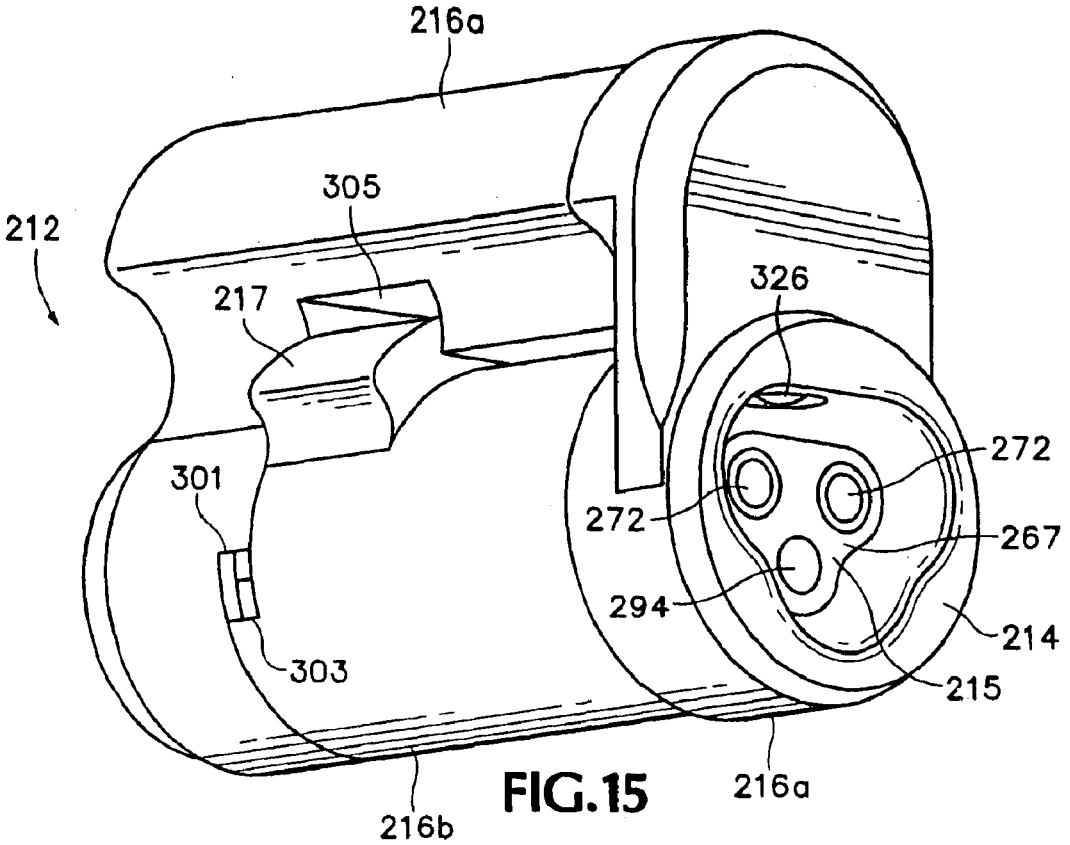
FIG. 15 is a perspective view of a second embodiment of a lock of the present invention.

In operation, the key microprocessor 132 and lock microprocessor 138 communicate with one another to allow the lock 12 to be unlocked. In one embodiment, both the key microprocessor 132 and the lock microprocessor 138 are capable of storing passwords, and key identification codes and lock identification codes respectively. Each key 18 and lock 12 has a unique identification code. The identification codes may be programed in the respective microprocessors when the key 18 or lock 12 is manufactured. Referring now to FIGS. 13 and 14, when a key 18 engages a lock 12, the key 18 sends power to the lock microprocessor 138. After the lock microprocessor 138 has stabilized, the lock microprocessor 138 sends out a handshake signal to the key microprocessor 132. The key microprocessor 132 sends a handshake signal back to the lock microprocessor 138. The lock microprocessor 138 then sends a signal corresponding to its identification code to the key microprocessor 132. The key microprocessor 132 then sends a key identification code and a password to the lock microprocessor 138. The lock microprocessor 138 determines whether the key identification code is authorized to open the lock 12, and then determines whether the password is correct. If so, the lock microprocessor 138 sends a signal to the key microprocessor 132, which in response provides power from the battery 28 through one of the pins 40 and contacts 70 to the solenoid 80 to unlock the lock 12.

Both the key microprocessor 132 and lock microprocessor 138 may store within their respective associated memories 134 and 140 activities occurring with respect to the key 18 and lock 12. Thus, the lock memory 140 may contain data representative of each key 18 which has attempted to open the lock 12, the time when the event occurred, the password that was supplied, and/or whether the lock 12 was opened. Likewise, each key 18 may store in its memory 134 each lock 12 that was accessed, the password provided to the lock 12, the time the lock 12 was accessed, and/or whether the lock 12 opened. The key microprocessor 132 and lock microprocessor 138 may be programmed using a programming device such as a Palm Pilot™ sold by 3 Com®. Data may be communicated over a cable using an RS 232 communication standard, or may also be transmitted using any other standard method for transmitting digital information.

The system can also be designed to utilize multiple access levels. Thus, some keys may only be authorized to open a limited number of locks, while other keys may be master keys capable of opening all locks.

The electronic locking system 10 may include an LED which may be used to indicate the status of the lock 12 or key 18, such as that an authorized key has been detected and that the lock 12 may be opened, or that the battery power is low. The electronic locking system 10 may also include a beeper to similarly communicate the status of the key 18 and/or lock 12. The beeper may be used to communicate, for example, when a master key has been detected, when an authorized key is detected, when a key code has been added to the authorized key codes in memory, and/or when a key identification code has been deleted from a lock memory. The beeper may also be used to sound an alarm in response to an attempt to open the lock 12 without first using an authorized key.

Of course, the same functions described above may be provided in the lock 212 of the second embodiment, it being realized that reference was made to the first embodiment for illustration only and not by way of limitation.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An electronic lock comprising:

(a) an elongate cylinder housed within a shell and rotatable about a longitudinal axis relative to said shell, said cylinder having respective front and rear portions located at different positions along said longitudinal axis;

(b) said cylinder containing an electrically-controlled locking mechanism including a locking member selectively movable alternatively toward engagement with said shell so as to interfere with rotation of said front and rear portions of said cylinder relative to said shell, or away from engagement with said shell so as to permit said rotation;

(c) said front portion being engageable with a key so as to enable said key to rotate said front portion relative to said shell, and said rear portion being detachably interconnected with said front portion so as to be rotatable by said key in unison with said front portion; and (d) said rear portion containing said locking member.

2. The lock of claim 1 wherein said electrically-controlled locking mechanism includes a solenoid assembly mounted in said front portion of said cylinder and movable substantially longitudinally of said cylinder selectively toward and away from said locking member.

3. The lock of claim 1 wherein said rear portion of said cylinder has at least a first longitudinally-extending cavity offset transversely from said locking member for matingly receiving at least one elongate throw pin.

4. The lock of claim 3 wherein said rear portion of said cylinder also has a second said longitudinally-extending cavity, said first and second cavities being offset transversely from said locking member on opposite sides thereof.

5. An electronic lock comprising:

(a) an elongate cylinder housed within a shell and rotatable about a longitudinal axis relative to said shell, said cylinder having respective front and rear portions located at different positions along said longitudinal axis;

(b) said rear portion of said cylinder containing an electrically-controlled locking mechanism including a locking member selectively movable alternatively toward engagement with said shell so as to interfere with rotation of said cylinder relative to said shell, or away from engagement with said shell so as to permit said rotation;

(c) said front portion being engageable with a key so as to enable said key to rotate said front portion relative to said shell, and said rear portion being detachably interconnected with said front portion so as to be rotatable by said key in unison with said front portion; and (d) said front portion and said rear portion having matingly-engageable protrusions detachably interconnecting said front portion and said rear portion so as to be rotatable by said key relative to said shell when said front portion and rear portion are interconnected.

6. The lock of claim 5 wherein said protrusions are located peripherally about said longitudinal axis of said cylinder.

7. The lock of claim 6 wherein said protrusions extend longitudinally of said cylinder.

8. An electronic lock comprising:

(a) an elongate cylinder housed within a shell, and rotatable about a longitudinal axis relative to said shell;

(b) said cylinder containing an electrically-controlled locking mechanism including a locking member selectively movable alternatively toward engagement with said shell so as to interfere with rotation of said cylinder relative to said shell, or away from engagement with said shell so as to permit said rotation;

(c) said cylinder having respective front and rear portions located at different positions along said longitudinal axis;

(d) said front portion being engageable with a key so as to enable said key to rotate said front portion relative to said shell, and said rear portion being detachably interconnected with said front portion so as to be rotatable by said key in unison with said front portion; and (e) said front portion being formed principally of a first material, and said rear portion being formed principally of a second material different from said first material.

9. The lock of claim 8 wherein said first material is ferromagnetic, and said second material is nonferromagnetic.

10. The lock of claim 9 wherein said electrically-controlled locking mechanism includes a solenoid assembly mounted in said front portion of said cylinder.

* * * * *

UNITED STATES PATENT AND TRADEMARK OFFICE

CERTIFICATE OF CORRECTION

PATENT NO. : 6,895,792 B2
APPLICATION NO. : 10/617345
DATED : May 24, 2005
INVENTOR(S) : Davis, Paul R.

It is certified that error appears in the above-identified patent and that said Letters Patent is hereby corrected as shown below:

Column 8, line 61 289 should be 269

Signed and Sealed this

Eighteenth Day of July, 2006

JON W. DUDAS
*Director of the United States Patent and Trademark Office*